US010672409B2

(12) United States Patent
Kawashima et al.

(10) Patent No.: US 10,672,409 B2
(45) **Date of Patent: *Jun. 2, 2020**

(54) DECODING DEVICE, ENCODING DEVICE, DECODING METHOD, AND ENCODING METHOD

(71) Applicant: Fraunhofer-Gesellschaft zur Foerderung der angewandten Forschung e.V., Munich (DE)

(72) Inventors: Takuya Kawashima, Ishikawa (JP); Hiroyuki Ehara, Kanagawa (JP)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/048,149

(22) Filed: Jul. 27, 2018

(65) Prior Publication Data

US 2018/0336908 A1 Nov. 22, 2018

Related U.S. Application Data

(63) Continuation of application No. 15/181,606, filed on Jun. 14, 2016, now Pat. No. 10,062,389, which is a (Continued)

(30) Foreign Application Priority Data

Feb. 28, 2014 (JP) ..... 2014-039431
Jul. 3, 2014 (JP) ..... 2014-137861

(51) Int. Cl.
*G10L 19/028* (2013.01)
*G10L 19/26* (2013.01)

(52) U.S. Cl.
CPC ..... *G10L 19/028* (2013.01); *G10L 19/26* (2013.01)

(58) Field of Classification Search
None
See application file for complete search history.

(56) References Cited

U.S. PATENT DOCUMENTS 5,680,972 A 10/1997 Clarke
9,384,749 B2 7/2016 Kawashima et al.
(Continued)

FOREIGN PATENT DOCUMENTS

CN 101131820 A 2/2008
CN 102208188 A 10/2011
(Continued)

*Primary Examiner* — Abul K Azad
(74) *Attorney, Agent, or Firm* — Michael A. Glenn; Perkins Coie LLP

(57) ABSTRACT

A decoding device includes: a separating unit separating first encoded data, a spectrum including a low-band spectrum of audio signals having been encoded, and second encoded data, a high-band spectrum of a higher band having been encoded, based on the first encoded data; a first decoding unit decoding the first encoded data and generating a first decoded spectrum; a first amplitude normalizer dividing amplitude of the first decoded spectrum into sub-bands, normalizing the spectrum of each sub-band by the largest amplitude of the first decoded spectrum within each sub-band, and generating a normalized spectrum; an addition unit adding noise spectrum to the normalized spectrum and generating a noise-added normalized spectrum; a second decoding unit decoding the second encoded data using the noise-added normalized spectrum, and generating a second noise-added spectrum; and a converter performing time-frequency conversion regarding a spectrum coupled based on the first decoded spectrum and second noise-added spectrum.

18 Claims, 19 Drawing Sheets

Related U.S. Application Data continuation of application No. PCT/JP2015/000537, filed on Feb. 6, 2015.

(60) Provisional application No. 61/974,689, filed on Apr. 3, 2014.

(56) References Cited

U.S. PATENT DOCUMENTS

| | | | | |
|---|---|---|---|---|
| 10,062,389 | B2 * | 8/2018 | Kawashima | G10L 19/028 |
| 2004/0161116 | A1 * | 8/2004 | Tsuji | G10L 19/008 381/22 |
| 2008/0052066 | A1 * | 2/2008 | Oshikiri | G10L 21/038 704/221 |
| 2008/0126082 | A1 * | 5/2008 | Ehara | G10L 19/24 704/205 |
| 2011/0106529 | A1 | 5/2011 | Disch et al. | |
| 2012/0288117 | A1 * | 11/2012 | Kim | G10L 19/028 381/94.2 |
| 2012/0323582 | A1 | 12/2012 | Peng et al. | |
| 2013/0018660 | A1 * | 1/2013 | Qi | G10L 19/002 704/500 |
| 2013/0034168 | A1 | 2/2013 | Fukui et al. | |
| 2013/0290003 | A1 * | 10/2013 | Choo | G10L 19/008 704/500 |
| 2014/0200901 | A1 * | 7/2014 | Kawashima | G10L 21/0388 704/500 |
| 2015/0294673 | A1 * | 10/2015 | Kawashima | G10L 19/032 704/206 |

FOREIGN PATENT DOCUMENTS

| | | | |
|---|---|---|---|
| CN | 102222505 | A | 10/2011 |
| CN | 102543086 | A | 7/2012 |
| EP | 2613315 | A1 | 7/2013 |
| EP | 2830062 | A1 | 1/2015 |
| JP | 2001-521648 | | 11/2001 |
| JP | 2002372993 | A | 12/2002 |
| RU | 2487426 | C2 | 7/2013 |
| WO | 2011111453 | A1 | 9/2011 |
| WO | 2012111767 | A1 | 8/2012 |
| WO | 2013035257 | A1 | 3/2013 |
| WO | 2013141638 | A1 | 9/2013 |

* cited by examiner

DECODING DEVICE, ENCODING DEVICE, DECODING METHOD, AND ENCODING METHOD

This application is a continuation of U.S. patent application Ser. No. 15/181,606 filed Jun. 14, 2016, which is a continuation of International Patent Application No. PCT/JP2015/000537 filed Feb. 6, 2015, which claims priority to U.S. Provisional Application No. 61/974,689 filed Apr. 3, 2014, which is incorporated herein by reference in its entirety, and additionally claims priority to Japanese Patent Application Nos. 2014-039431 filed Feb. 28, 2014 and 2014-137861 filed Jul. 3, 2014, all of which are incorporated herein by reference in its entirety.

BACKGROUND

1. Technical Field

The present invention relates to decoding and encoding audio signals to reduce musical noise in audio signals and music signals (hereinafter referred to as audio signals and so forth).

2. Description of the Related Art

Music encoding technology that compresses audio signals at a low bitrate is an important technology in efficient usage of radio waves and the like in mobile communication. Further, there has been more demand for higher quality in phone call audio in recent years, and there is desire for a call service that has a real-life sensation. This can be realized by encoding audio signals and so forth of a wide frequency band at a high bitrate. However, this approach contradicts efficient use of radio waves and frequency bands.

As for a method to encode signals of a wide frequency band with high quality at a low bitrate, there is a technology where the spectrum of input signals is device into the two spectrums of a low-band portion and a high-band portion, with the high-band portion being substituted by a duplicate of the low-band portion. That is to say, the overall bitrate is reduced by substituting the low-band portion for the high-band portion (Japanese Unexamined Patent Application Publication (Translation of PCT Application) No. 2001-521648).

Based on this technology, there is a technology that, in light of the fact that the high-band spectrum has less deviation than the low-band spectrum, the low-band spectrum is normalized (smoothed) for each sub-band, after which correlation with the high-band spectrum is obtained. Accordingly, sound quality deterioration can be prevented by copying the low-band spectrum that has high peak features. However, this technology has a shortcoming in that, due to the low-band spectrum being expressed as a discrete pulse stream, the envelope of input signals in the method estimating the envelope of the discrete pulse stream is entirely different from the original envelope. Accordingly, a method has been proposed instead of this normalization method, where normalization is performed at the maximum amplitude value of discrete pulses, at each sub-band (International Publication No. 2013/035257).

FIG. 11 is the encoding device according to International Publication No. 2013/035257. In this encoding device, input signals are converted into frequency region signals by a time-frequency converter 1010 and output as an input signal spectrum, and the low-frequency region of the input signal spectrum is encoded at a core encoding unit 1020 and output as core encoded data. The core encoded data is then decoded and a core encoded low-frequency spectrum is generated, which is normalized by the maximum value of the amplitude at a sub-band amplitude normalization unit 1030 and a normalized low-band spectrum is generated. The band of the high-band portion where the correlation value as to the normalized low-band spectrum is greatest, and the gain between the normalized low-band spectrum at this band and the high-band portion of the input spectrum, are obtained, and these are encoded at an extended band encoding unit 1060, and output as extended band encoded data.

FIG. 12 illustrates a decoding device corresponding to this. The encoded data is divided into core encoded data and extended band encoded data at a separating unit 2010, the core encoded data is decoded at a core decoding unit 2020, and a core encoded low-band spectrum is generated. The core encoded low-band spectrum is subjected to the same processing as at the encoding device side, which is normalization by the largest value of the sample amplitude, thereby generating normalized low-band spectrum data. The normalized low-band spectrum data is then used to decode the extended band encoded data by an extended band decoding unit 2040, thereby generating the extended band spectrum.

Also disclosed is technology where switching is performed between the sub-band amplitude normalization unit 1030 that performs normalization at the largest value of the sample, and a spectrum envelope normalization unit 7020 that normalizes the envelope of the spectral power of the sample, in accordance with the intensity of the peak features, as illustrated in FIG. 13.

The technology of normalization at the largest value of the sample, described in International Publication No. 2013/035257, is effective in a case where the low-band spectrum is sparse, i.e., in a case where the amplitude value of just part of the samples is large and the amplitude value of the other samples is almost zero. That is to say, the technology according to International Publication No. 2013/035257 suppresses spectrums with extremely large amplitude from being generated even for sparse spectrums (homogenizing), and can yield normalized low-band spectrums with flat features (smoothing).

SUMMARY

However, spectral holes readily occur when the pulse stream is sparse, and such spectral holes cause noise that is called musical noise. International Publication No. 2013/035257 does not disclose any measures taken against musical noise due to spectral holes when normalizing the low-band spectrum by the largest amplitude of the sample.

One non-limiting and exemplary embodiment provides a decoding device and encoding device capable of decoding high-quality audio signals and so forth with suppressed musical noise, while reducing the overall bitrate.

In one general aspect, the techniques disclosed here feature a decoding device including:

- a separating unit that separates first encoded data, where a spectrum including a low-band spectrum of audio signals has been encoded, and second encoded data where a high-band spectrum of a higher band than the low-band spectrum has been encoded, based on the first encoded data;
- a first decoding unit that decodes the first encoded data and generates a first decoded spectrum;
- a first amplitude normalizer that divides the amplitude of the first decoded spectrum into a plurality of sub-bands, normalizes the spectrum of each sub-band by the largest value of the amplitude of the first decoded spectrum within each sub-band, and generates a normalized spectrum;

an addition unit that adds noise spectrum to the normalized spectrum and generates a noise-added normalized spectrum;

a second decoding unit that decodes the second encoded data using the noise-added normalized spectrum, and generates a second noise-added spectrum; and a converter that performs time-frequency conversion regarding a spectrum coupled based on the first decoded spectrum and the second noise-added spectrum.

According to a decoding device of an embodiment of the present disclosure, high-quality audio signals and so forth can be decoded with suppressed musical noise. It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Configurations and operations of embodiments of the present disclosure will be described below with reference to the drawings. Note that output signals from decoding devices and input signals to encoding devices in the present disclosure encompass, in addition to cases of audio signals in the narrow sense, also cases of music signals having broader bandwidth, and further cases where these coexist. Note that in the present specification, "input signals" is a concept that encompasses not only audio signals, but also music signals having broader bandwidth than audio signals, and signals where audio signals and music signals coexist.

"Noise spectrum" is a spectrum where the amplitude irregularly fluctuates. If the cycle is regular but long enough to be considered to be essentially irregular, this is considered to be included in irregular.

To "generate" a noise spectrum includes causing a noise spectrum to occur, and also includes output a noise spectrum saved in a storage device or the like beforehand. With regard to "coupling" and "time-frequency conversion", which is temporally first is optional, and may be at the same time as a matter of course. I it is sufficient that "coupling" and "time-frequency conversion" are performed as a result.

"Bit allocation information" means information representing the number of bits allocated to a predetermined band of a core decoded spectrum.

"Sparse information" is information representing the distribution state of zero spectrums or non-zero spectrums in a core decoded spectrum, and for example, is information that directly or indirectly indicates the proportion of non-zero spectrums or zero spectrums as to total spectrums, a predetermined band of a core decoded spectrum.

"Correlation" represents the similarity of two spectrums. This also includes cases where similarity is quantitatively evaluated using an index of correlation.

A "terminal device" is a device that the user side uses, examples thereof being cellular phones, smartphones, karaoke devices, personal computers, television sets, digital voice recorders, and so forth.

A "base station device" is a device that directly or indirectly transmits signals to a terminal device, or directly or indirectly receives signals from the terminal device. Examples include eNode B, various types of servers, access points, and so forth.

A "non-zero component" (or non-zero content) is a component (or content) where a pulse is deemed to exist. Pulses that are equal to or smaller than a predetermined intensity to where pulses are not deemed to exist are zero component (or zero content), and not non-zero component. That is to say, not all pulses contained in an original normalized spectrum are necessarily non-zero components.

First Embodiment

Figure 1:
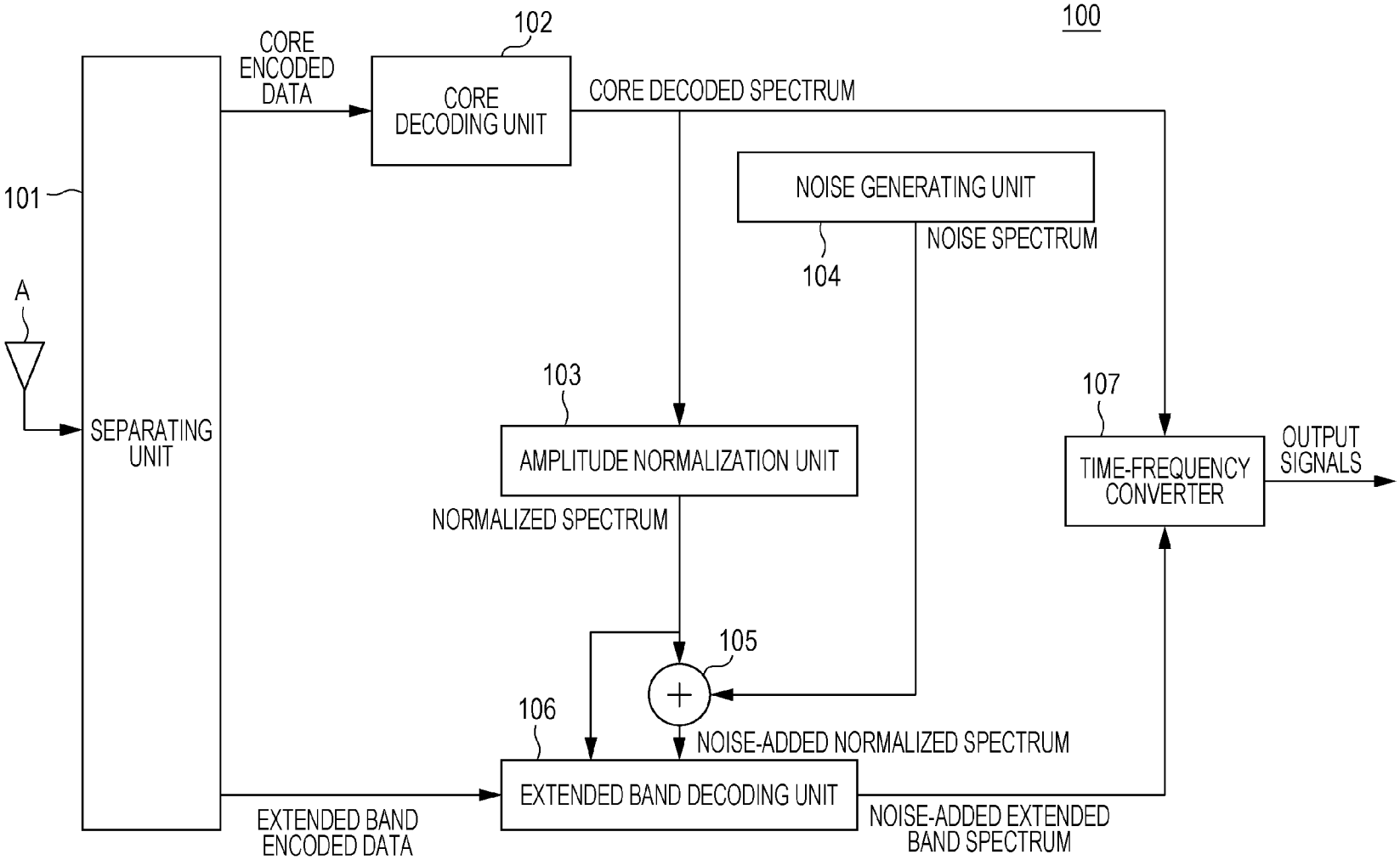
FIG. 1 is a configuration diagram of a decoding device according to a first embodiment of the present disclosure.

FIG. 1 is a block diagram illustrating the configuration of a decoding device according to a first embodiment. The decoding device 100 illustrated in FIG. 1 includes a separating unit 101, a core decoding unit (first decoding unit) 102, an amplitude normalization unit 103, a noise generating unit 104, a first addition unit 105, an extended band decoding unit (second decoding unit) 106, and a time-frequency converter 107. An antenna A is connected to the separating unit 101.

The antenna A receives core encoded data and extended band encoded data. The core encoded data (first encoded data) is encoded data obtained by encoding a low-band spectrum of a predetermined frequency or below in input signals by an encoding device. Extended band encoded data is encoded data obtained by encoding a high-band spectrum of a predetermined frequency or above in input signals. Extended band encoded data (second encoded data) is encoded based on a core encoded low-band spectrum (first encoded spectrum) obtained by decoding core encoded data of a high-band spectrum of a predetermined frequency in input signals.

As a specific example, lag information that is information indicating a particular band where the correlation between a high-band spectrum and core encoded low-band spectrum is greatest, and gain between a high-band spectrum and core encoded low-band spectrum in a particular band. This encoding will be described by way of a specific example in a fifth embodiment. Note that amplitude band encoded data input to the decoding device according to the present embodiment is not restricted to this specific example.

The separating unit 101 separates the input core encoded data and extended band encoded data. The separating unit 101 outputs the core encoded data to the core decoding unit 102, and the extended band encoded data to the extended band decoding unit 106.

The core decoding unit 102 decodes the core encoded data and generates a core decoded spectrum (first decoded spectrum). The core decoding unit 102 outputs the core decoded spectrum to the amplitude normalization unit 103 and time-frequency converter 107.

The amplitude normalization unit (first amplitude normalization unit) 103 normalizes the core decoded spectrum and generates a normalized spectrum. Specifically, the amplitude normalization unit 103 divides the core decoded spectrum into multiple sub-bands, and normalizes the spectrum of each sub-band by the greatest value of amplitude (absolute value) of the spectrum included in each sub-band. Thus, the largest value of the spectrum in each sub-band after normalization is unified among the sub-bands. Accordingly, there are no more any spectrums with extremely large amplitude in the normalized spectrum.

Note that dividing the core decoded spectrum into sub-bands is optional. The method of division into sub-bands also is optional. For example, the bandwidth of the sub-bands may be uniform, or not uniform.

The amplitude normalization unit 103 outputs the normalized spectrum to the first addition unit 105 and extended band decoding unit 106. The noise generating unit 104 generates a noise spectrum. A noise spectrums a spectrum where the amplitude irregularly fluctuates. A specific example is a spectrum where positive/negate is randomly assigned to each frequency component. As long as positive/negate is random, the amplitude may be a constant value, or may be a randomly-generated amplitude value within a range.

The method of generating the noise spectrum may be generated as necessary based on random numbers, or an arrangement where a noise spectrum generated beforehand is saved in a storage device such as memory or the like, and is called up and output. Multiple noise spectrums may be called up and added, odd-numbered components and even-numbered components may be combined, and polarity may be randomly assigned when adding or combining. Alternatively a zero spectrum component in the core decoded spectrum may be detected and a noise spectrum generated to fill in this. Further, a noise spectrum may be generated in accordance with characteristics of a core decoded spectrum.

Note that the noise spectrum is not restricted to one, and that one may be selected and output from multiple noise spectrums in accordance with predetermined conditions. An example of multiple noise spectrums being generated will be described in a third embodiment.

The noise generating unit 104 outputs the noise spectrum to the first addition unit 105. The first addition unit 105 adds the normalized spectrum and the noise spectrum and generates a noise-added normalized spectrum. Accordingly, the noise spectrum is added to at least the zero component region of the normalized spectrum. The first addition unit 105 then outputs the noise-added normalized spectrum to the extended band decoding unit (second decoding unit) 106.

In the present embodiment, the noise spectrum is added to the normalized spectrum that is a spectrum after normalization at the amplitude normalization unit 103, and not to the core decoded spectrum that is the input spectrum before normalization at the amplitude normalization unit 103. The reason is as follows.

The amplitude of the added noise spectrum is usually smaller than the amplitude of the core decoded spectrum, and the core decoded spectrum is sparse, so in a case of performing normalization for short sub-bands that are around 15 samples are so forth, many sub-bands will be all zero. Adding the noise spectrum to the core before normalization in such a case has the following problem.

First, a low-level noise spectrum is added to the all-zero sub-band. This noise spectrum itself thus becomes the larges value and is normalized as 1, so if there is no peak in the sub-band, the overall noise is amplified. On the other hand, in a case where there is a peak within the sub-band, the spectrum of the peak that originally exists is the greatest value, so the noise component remains at a low level by normalization, or actually becomes smaller due to the normalization. Accordingly, noise spectrums with large amplitude are locally added to sub-bands originally having all-zero components. Conversely, the present embodiment adds the noise spectrum to the after normalization, so excess amplification of the noise spectrum due to normalization can be prevented.

The extended band decoding unit 106 decodes extended band encoded data (second encoded data) using the noise-added normalized spectrum and normalized spectrum. Specifically, the extended band decoding unit 106 decodes the extended band encoded data and obtains lag information and gain. The extended band decoding unit 106 identifies the band of the noise-added normalized spectrum to be copied to the extended band that is the high-band portion, based on the lag information and normalized spectrum, and copies a predetermined band of the noise-added normalized spectrum to the extended band. The extended band decoding unit 106 obtains the noise-added extended band spectrum by multiplying the copied noise-added normalized spectrum by the decoded gain.

The extended band decoding unit 106 then outputs the noise-added extended band spectrum to the time-frequency converter 107. The time-frequency converter 107 couples the core decoded spectrum making up the low-band portion and the noise-added extended band spectrum making up the high-band portion, thereby generating a decoded spectrum. The time-frequency converter 107 then converts the decoded spectrum into time region signals by performing orthogonal transform on the decoded spectrum, and outputs as output signals. The output signals output from the decoding device 100 pass through a DA converter, amplifier, speaker, and so forth, that are omitted from illustration, and output as audio signals, music signals, or signals where these coexist.

Thus, according to the present embodiment, the normalized spectrum is added to the normalized spectrum, so occurrence of musical noise can be suppressed even in a case where the normalized spectrum is sparse. That is to say, the present embodiment yields the advantages that the advantages of homogenizing and smoothing that are obtained by normalizing by the largest value of a spectrum can be maintained, while compensating for the shortcomings that this normalization method has.

Also, the noise spectrum has been added to the normalized spectrum after normalization at the amplitude normalization unit 103 in the present embodiment, so excessive amplification of the noise spectrum by the normalization can be prevented, thereby yielding the advantage that output signals with high sound quality can be obtained.

Second Embodiment

Figure 2:
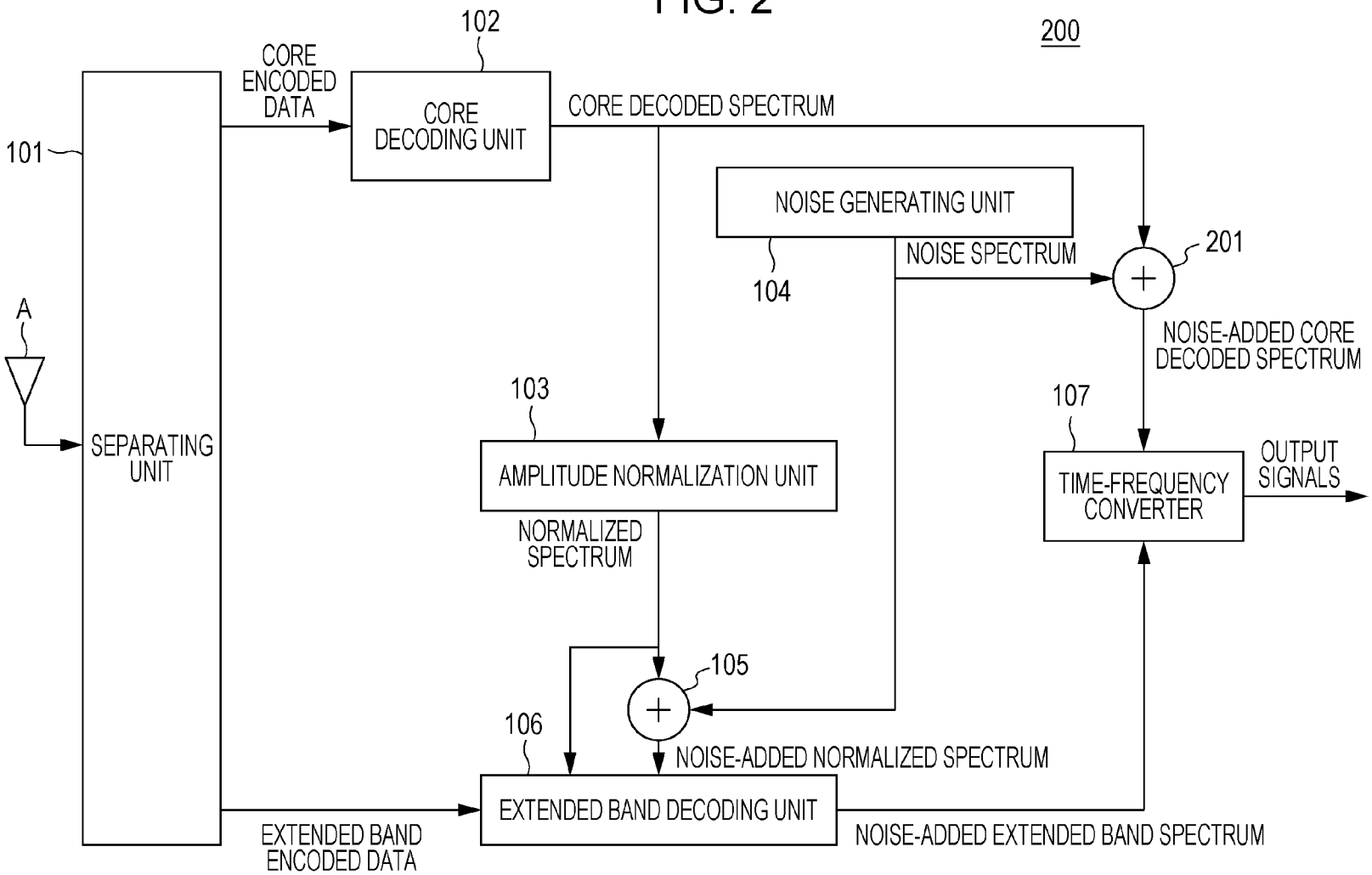
FIG. 2 is a configuration diagram of a decoding device according to a second embodiment of the present disclosure.

Next, the configuration of a decoding device 200 according to a second embodiment of the present disclosure will be described with reference to FIG. 2. Blocks having the same configuration as in FIG. 1 are denoted by the same reference numerals. The difference between the decoding device 200 according to the present embodiment and the decoding device 100 in the first embodiment is that the decoding device 200 has a second addition unit 201. Other components are basically the same as in the first embodiment, so description will be omitted.

The second addition unit 201 adds the noise spectrum generated by the noise generating unit 104 to the core decoded spectrum output from the core decoding unit 102, and generates a noise-added core decoded spectrum. The second addition unit 201 then outputs the noise-added core decoded spectrum to the time-frequency converter 107.

The time-frequency converter 107 couples the noise-added core decoded spectrum making up the low-band portion and the noise-added extended band spectrum making up the high-band portion, thereby generating a decoded spectrum. The time-frequency converter 107 then converts the decoded spectrum into time region signals by performing orthogonal transform on the decoded spectrum, and outputs as output signals.

Thus, according to the present embodiment, the noise spectrum is added not only to the normalized spectrum making up the high-band portion but also the core decoded spectrum making up the low-band portion, so musical noise occurring from the low-band spectrum, which is important for listening, can be suppressed. Of course, musical noise can be suppressed even in a case of generating output signals using the core decoded spectrum alone.

Other Example of Second Embodiment

Figure 3:
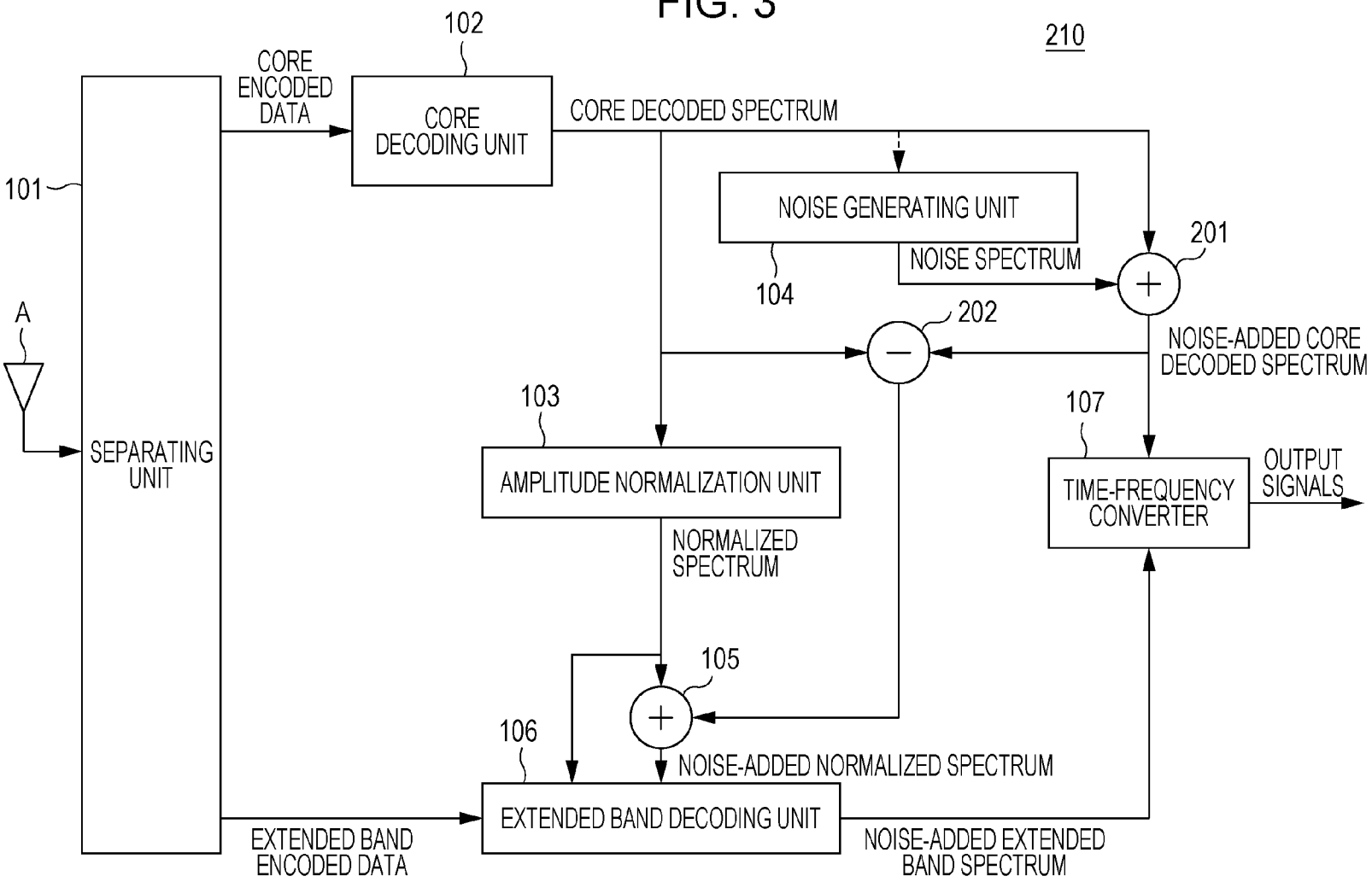
FIG. 3 is a configuration diagram of another decoding device according to the second embodiment of the present disclosure.

Next, the configuration of a decoding device 210 that is another example of the second embodiment of the present disclosure will be described with reference to FIG. 3. Blocks having the same configuration as in FIGS. 1 and 2 are denoted by the same reference numerals. The decoding device 210 according to the present embodiment differs from the decoding device 200 in the second embodiment in that does not output the noise spectrum, that is output to the first addition unit 105, directly from the noise generating unit 104, but rather generates the noise spectrum by subtracting the core decoded spectrum from the noise-added core decoded spectrum at the subtraction unit 202, and outputs this. Other components are basically the same as in the second embodiment, so description will be omitted.

The noise generating unit 104 detects a zero spectrum component of the core decoded spectrum, and generates a noise spectrum to fill in this. The second addition unit 201 adds the noise spectrum generated by the noise generating unit 104 to the core decoded spectrum output from the core decoding unit 102 and generates a noise-added core decoded spectrum. The second addition unit 201 then outputs the noise-added core decoded spectrum to the time-frequency converter 107 and a subtraction unit 202.

The subtraction unit 202 subtracts the core decoded spectrum from the noise-added decoded spectrum, and takes this difference as the noise spectrum and outputs to the first addition unit 105.

The reason that this processing is performed will be described below. Processing of adding the noise spectrum to the core decoded spectrum can be realized by detecting a zero spectrum component of the core decoded spectrum, and adding in a noise spectrum to fill in this, as in the case of the present embodiment, beside a case of realizing by adding the noise spectrum independently generated as to the core decoded spectrum. In this case, the normalized spectrum is imposed on the core decoded spectrum and immediately becomes integral with the core decoded spectrum, so the noise spectrum to be output to the first addition unit 105 needs to be obtained by a separate method.

Accordingly, the subtraction unit 202 is provided in the present embodiment, and the core decoded spectrum is subtracted from the noise-added core decoded spectrum, thereby extracting the noise spectrum. In this case, the noise generating unit 104, second addition unit 201, and subtraction unit 202 together make up the noise generating unit according to the present disclosure.

Thus, according to the present embodiment, the noise spectrum is not added to spectrums other than a zero spectrum of the spectrums making up the core decoded spectrum, so more accurate decoding can be performed, and output signals with high image quality can be obtained.

Third Embodiment

Figure 4:
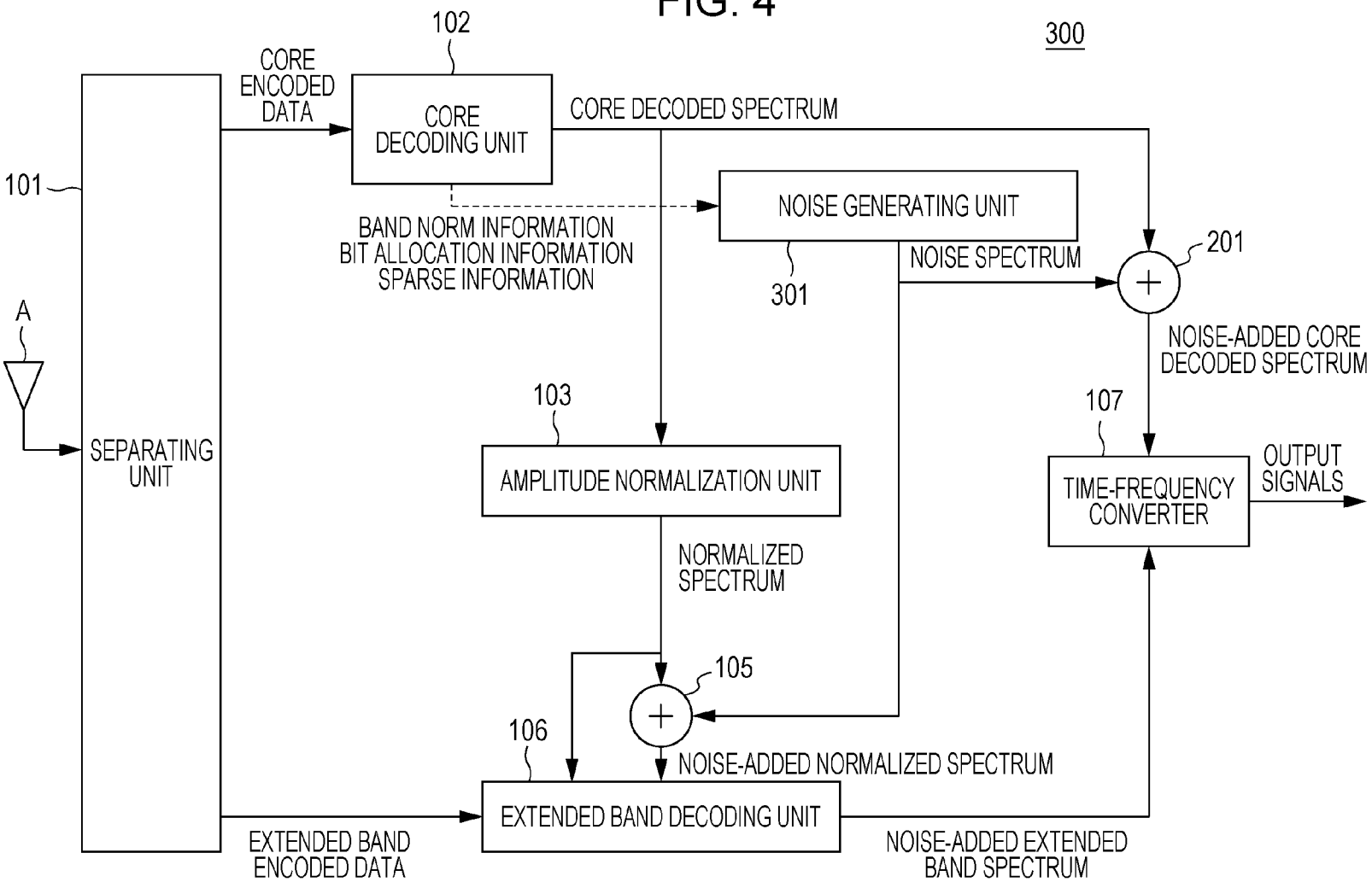
FIG. 4 is a configuration diagram of a decoding device according to a third embodiment of the present disclosure.

Next, the configuration of a decoding device 300 of a third embodiment according to the present disclosure will be described with reference to FIG. 4. Blocks having the same configuration as in FIGS. 1 and 2 are denoted by the same reference numerals.

The difference between the decoding device 300 according to the present embodiment and the decoding device 200 according to the second embodiment is in that the decoding device 300 has a noise generating unit 301 instead of the noise generating unit 104. Other components are basically the same as in the second embodiment, so description will be omitted.

The noise generating unit 301 is capable of generating multiple different noise spectrums, and can change the output noise spectrums in accordance with the characteristics of the core decoded spectrums.

Figure 5:
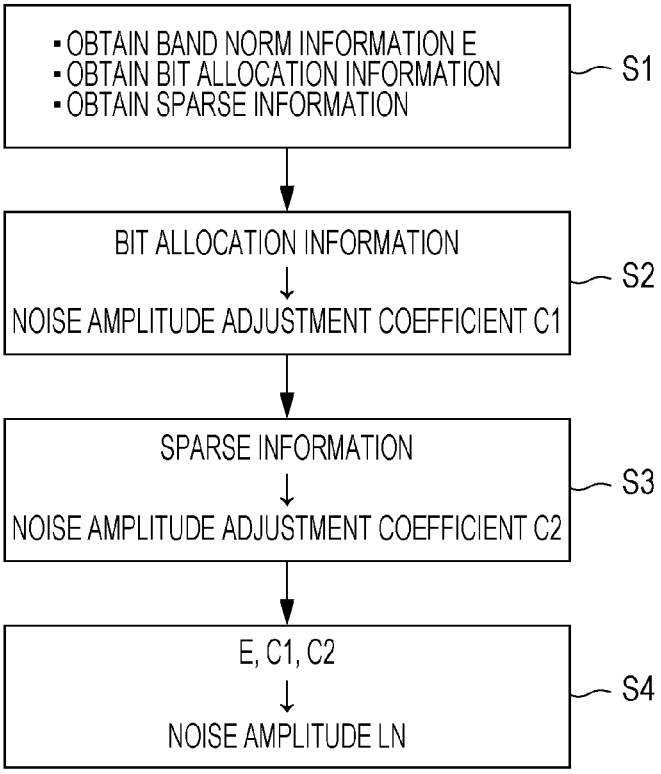
FIG. 5 is an explanatory diagram of a noise generating unit according to the third embodiment of the present disclosure.

FIG. 5 is a flowchart illustrating the operation of the noise generating unit 301. The noise generating unit 301 receives band norm information from the core decoding unit 102 (band average amplitude information), bit allocation information, and sparse information (S1). But allocation information is information representing the number of bits allocated to a particular band of the core decoded spectrum. For in example, ITU-T Recommendations G.722.1 and also G.719 of the same, norm information of a spectrum (average value of amplitude for each band, or information according thereto (scaling coefficient, band energy, etc.)) is encoded, and bit allocation is decide base on this norm information. Sparse information is information indicating the proportion of non-zero spectrums as to all spectrums in a particular band of the core decoded spectrum (or conversely may be defined as the proportion of zero spectrums). Next, the noise generating unit 301 calculates a first noise amplitude adjustment coefficient C1 using bit allocation information (S2). C1 is calculated using a function F(b) of an allocated bit count b, for example. F(b) outputs a fixed value Nb when b=0, outputs 0 when b>ns, and outputs a value between Nb and 0 when 0≤b≤ns, where the closer that b is to ns, the closer the value is to 0. For example this is a function such as illustrated in the following Expression (1)

$$F(b) = Nb \times (ns - b)/ns \quad (0 \le b \le ns) \qquad (1)$$
$$F(b) = 0 \quad (b > ns)$$

where Nb is a constant between 0 and 1.0, and is a value of a noise amplitude adjustment coefficient used in a case where there is no bit allocation, and ns is a constant that is a bit count necessary for high-quality quantization of the spectrum. In the number of bits is the same number as this bit count or more, quantization can be performed at a level where quantization error is not problematic, so there is no need to add noise. C1 may be calculated for every band where bit allocation is performed, or multiple bands may be bunched, and calculated for the overall bunched bands.

Further, the noise generating unit 301 outputs a second noise amplitude adjustment coefficient C2 using sparse information (S3). C2 is defined as in the following Expression (2) as a zero spectrum proportion Sp in the total number of spectrums of the object bands, for example, $$Sp = \frac{Nz}{Lb} \qquad (2)$$

where Nz represents the number of zero spectrums, and Lb represents the total number of spectrums of the object bands.

The larger the proportion of zero spectrums is, the larger the value of Sp is, which is a variable between 0 and 1.0. The following Expression (3) may be used instead of Expression (2).

$$Sp = \frac{1}{Lb - Nz + 1} \qquad (3)$$

Finally, the noise generating unit 301 uses the first and second noise amplitude adjustment coefficients C1 and C2 to calculate a noise amplitude LN based on the following Expression (4) (S4), $$LN = |E(i)| \cdot C1 \cdot C2 \qquad (4)$$
$$= |E(i)| \cdot F(b) \cdot Sp$$

where |E(i)| is the band norm information (band average amplitude information) for the i'th band, and b and Sp represent the bit allocation count and space information regarding the i'th band.

Although both C1 and C2 have been described as being used in the present embodiment, LN may be obtained using just one or the other.

Thus, in the present embodiment, the noise generating unit 301 decides the amplitude of the noise spectrum to be generated, based on band norm information, bit allocation information, and sparse information. Accordingly, the noise spectrum can be adaptively added based on the coarseness of quantization, thereby yielding the advantage that noise deterioration due to adding to much noise where fine quantization has been realized can be avoided.

Although an example has been described in the present embodiment where the bit allocation information and sparse information are output from the core decoding unit 102, this is not restrictive. For example, an arrangement may be made where the core decoded spectrum is input to the noise generating unit 301, the noise generating unit 301 analyzes the core decoded spectrum, and obtains the band norm information, bit allocation information, and space information by itself.

Note that an arrangement has been described where the noise generating unit 104 in the second embodiment is substituted by the noise generating unit 301, but the noise generating unit 104 according to the first embodiment may be substituted by the noise generating unit 301.

Although the present embodiment describes LN as being calculated and applied for each band i, multiple bands may be bunched and calculated and adapted, or the average value of LN calculated for each i may be applied as a uniform LN for all bands.

Fourth Embodiment

Next, the configuration of a decoding device 400 according to a fourth embodiment of the present disclosure will be described with reference to FIG. 6. Blocks having the same configuration as FIGS. 1, 2, and 4 are denoted with the same reference numerals. The difference between the decoding device 400 according to the present embodiment and the decoding device 200 according to the second embodiment is that the decoding device 400 according to the present embodiment includes a noise amplitude normalization unit (second amplitude normalization unit) 401 and an amplitude adjusting unit 402. Other components are basically the same as the second embodiment, so description will be omitted.

The noise amplitude normalization unit 401 normalizes the normalized spectrum generated at the noise generating unit 104 and generates a normalized noise spectrum. The operations of the noise amplitude normalization unit 401 are the same as the operations of the amplitude normalization unit 103, but may be different. For example, in a case where processing is performed at the amplitude normalization unit 103 to set the spectral components below a threshold value to zero in order to make sparse, this threshold value may be set to a low threshold value at the noise amplitude normalization unit 401 to make the degree of sparseness small as to the noise spectrum.

The noise amplitude normalization unit 401 then outputs the normalized noise spectrum to the amplitude adjusting unit 402. The amplitude adjusting unit 402 adjusts the amplitude of the normalized noise spectrum that the noise amplitude normalization unit 401 has output. The normalized noise spectrum of which the amplitude has been adjusted is then output to the first addition unit 105. Details of operations of the amplitude adjusting unit 402 are described later.

The first addition unit 105 adds the normalized spectrum and the normalized noise spectrum of which the amplitude has been adjusted, thereby generating a noise-added normalized spectrum. The first addition unit 105 the outputs the noise-added normalized spectrum to the extended band decoding unit 106.

Figure 7:
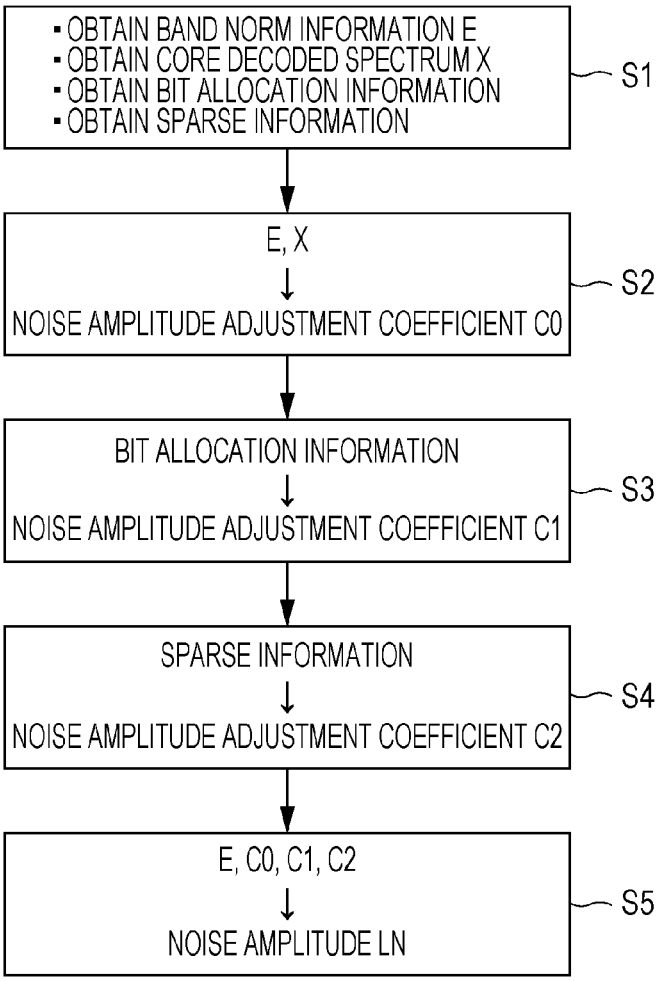
FIG. 7 is an explanatory diagram of an amplitude adjusting unit according to the fourth embodiment of the present disclosure.

FIG. 7 is a flowchart illustrating the operations of the amplitude adjusting unit 402. The amplitude adjusting unit 402 receives the core decoded spectrum X(j), band norm information |E(i)|, bit allocation information, and sparse information, output from the core decoding unit 102 (S1).

The amplitude adjusting unit 402 then analyzes the core decoded spectrum X(j) and band norm information |E(i)|, and obtains the difference between an average amplitude |XE(i)| calculated from the core decoded spectrum X(j) and the band norm information |E(i)| (band norm information). The ratio between the obtained error and the decoded norm (band norm information) is used to calculate a noise amplitude adjustment coefficient according to the following Expression (5) (S2), $$C0 = \alpha \times \frac{|E(i)| - |XE(i)|}{|E(i)|} \tag{5}$$

where i represents the band No., j represents the spectrum No. included in the i'th band, and α is an adjusting coefficient that assumes a value between 0 and 1.0. The amplitude adjusting unit 402 then calculates the noise amplitude adjustment coefficient C1 according to Expression (1), in the same way as the third embodiment, using the bit allocation information (S3).

The amplitude adjusting unit 402 further calculates the noise amplitude adjustment coefficient C2 according to Expression (2), in the same way as the third embodiment, using the sparse information of the normalized spectrum (S4).

Finally, the amplitude adjusting unit 402 calculates the noise amplitude LN by the following Expression (6) based on the results of (S2), (S3), and (S4), and adjusts the amplitude of the normalized noise spectrum (S5).

$$\begin{aligned} LN &= |E(i)| \cdot C0 \cdot C1 \cdot C2 \\ &= |E(i)| \cdot \alpha \times \frac{|E(i)| - |XE(i)|}{|E(i)|} \cdot F(b) \cdot Sp \\ &= \alpha \times (|E(i)| - |XE(i)|) \cdot F(b) \cdot Sp \end{aligned} \tag{6}$$

Although all of C0, C1, and C2 were used in the present embodiment, LN may be obtained using at least one. Also, although sparse information of the normalized spectrum is used as the sparse information of obtaining C2 in the present embodiment, sparse information obtained form the core decoded spectrum may be used, or both may be used in conjunction.

Further, an arrangement may be made where the amplitude ratio of the core decoded spectrum and the noise spectrum added to the decoded spectrum is a noise amplitude adjustment coefficient C3, and the noise amplitude LN is obtained from the following Expression (7) based on C3. Of course, C3 may be obtained independently, and LN may be obtained using at least one of C0, C1, C2, and C3.

$$LN = |E(i)| \cdot C0 \cdot C1 \cdot C2 \cdot C3 \tag{7}$$

Note that LN is preferably smoothed between frames, for inter-frame stability of noise level. An expression such as LN(f)=μ×LN(f−1)+(1−μ)×LN(f) may be used for smoothing. Here, LN(f) is LN at frame No. f, and μ is a smoothing coefficient. μ assumes a value between 0 and 1.

According to the present embodiment, the core decoded spectrum is normalized at the amplitude normalization unit 103, whereas the noise spectrum is normalized at the noise amplitude normalization unit 401, so spectrums having a common nature are yielded (e.g., the amplitude of the spectrums is generally uniform) by the core decoded spectrum and noise spectrum passing through matching paths, so both signals can be made to be signals that can be handled on the same stage.

Also, according to the present embodiment, the noise spectrum added to the high-band portion (normalized noise spectrum) is output via the noise amplitude normalization unit 401 and amplitude adjusting unit 402, whereas the noise spectrum added to the low-band portion does not go through the noise amplitude normalization unit 401 nor amplitude adjusting unit 402, so the characteristics can be made to differ between the noise spectrum added to the high-band portion (normalized noise spectrum) and the noise spectrum added to the low-band portion. Accordingly, the correlation can be reduced between the low-band portion and high-band portion, whereby a noise spectrum with more random characteristics can be generated.

According to the present embodiment, the normalized noise spectrum has the amplitude adjusted at the amplitude adjusting unit 402, thus yielding the advantage that deterioration due to adding to much noise can be avoided.

Although an example has been described in the present embodiment where the bit allocation information and sparse information are output from the core decoding unit 102, this is not restrictive. For example, an arrangement may be made where the core decoded spectrum is input to the amplitude adjusting unit 402, the amplitude adjusting unit 402 analyzes the core decoded spectrum, and obtains the band norm information, bit allocation information, and space information by itself.

Note that an arrangement has been described where the noise amplitude normalization unit 401 and amplitude adjusting unit 402 are added to the configuration of the second embodiment, these may be added to the first embodiment or third embodiment.

Other Example of Fourth Embodiment

Figure 8:
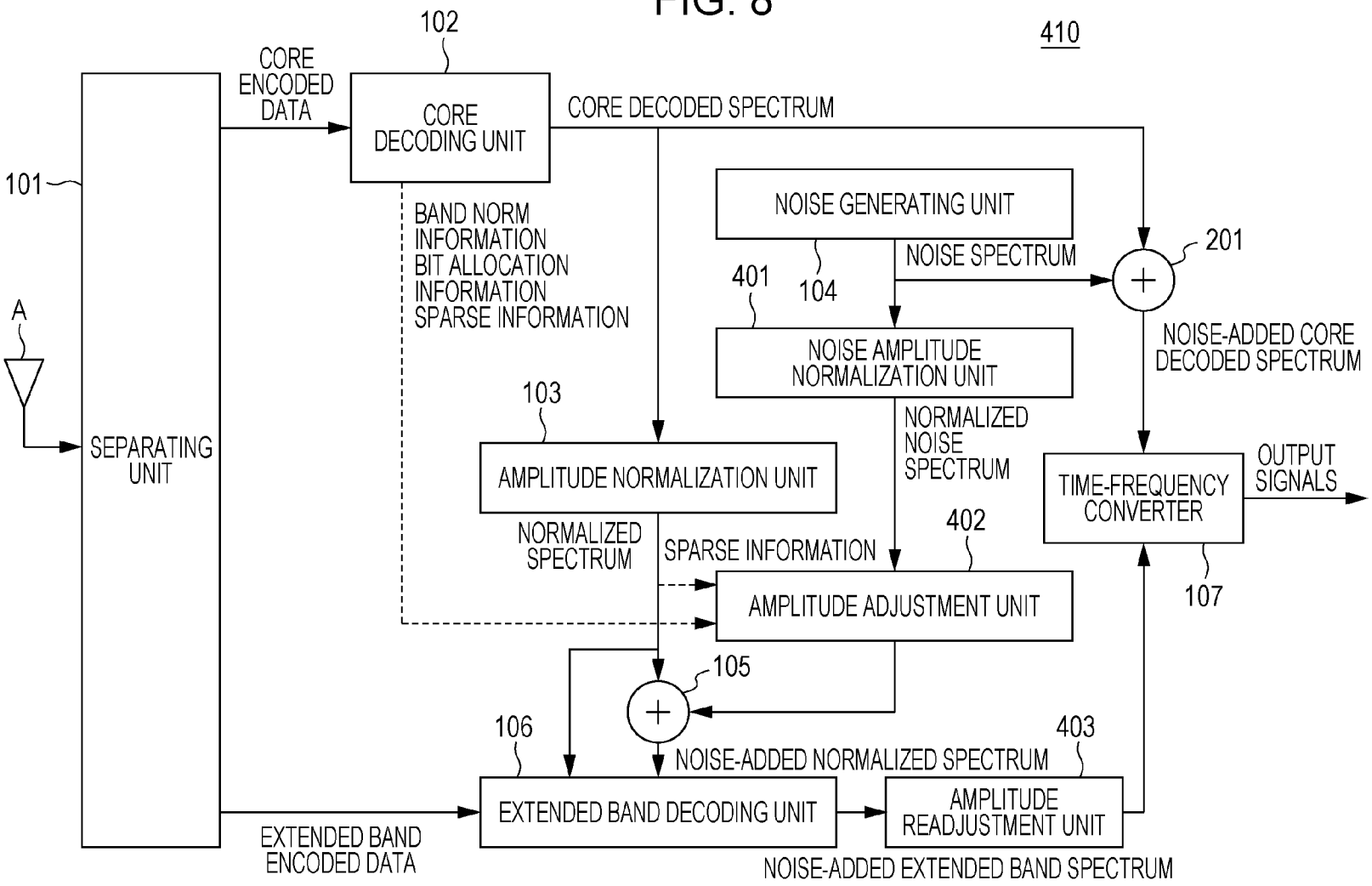
FIG. 8 is a configuration diagram of another decoding device according to the fourth embodiment of the present disclosure.

Next, the configuration of another decoding device 410 according to the fourth embodiment of the present disclosure will be described with reference to FIG. 8.

Figure 6:
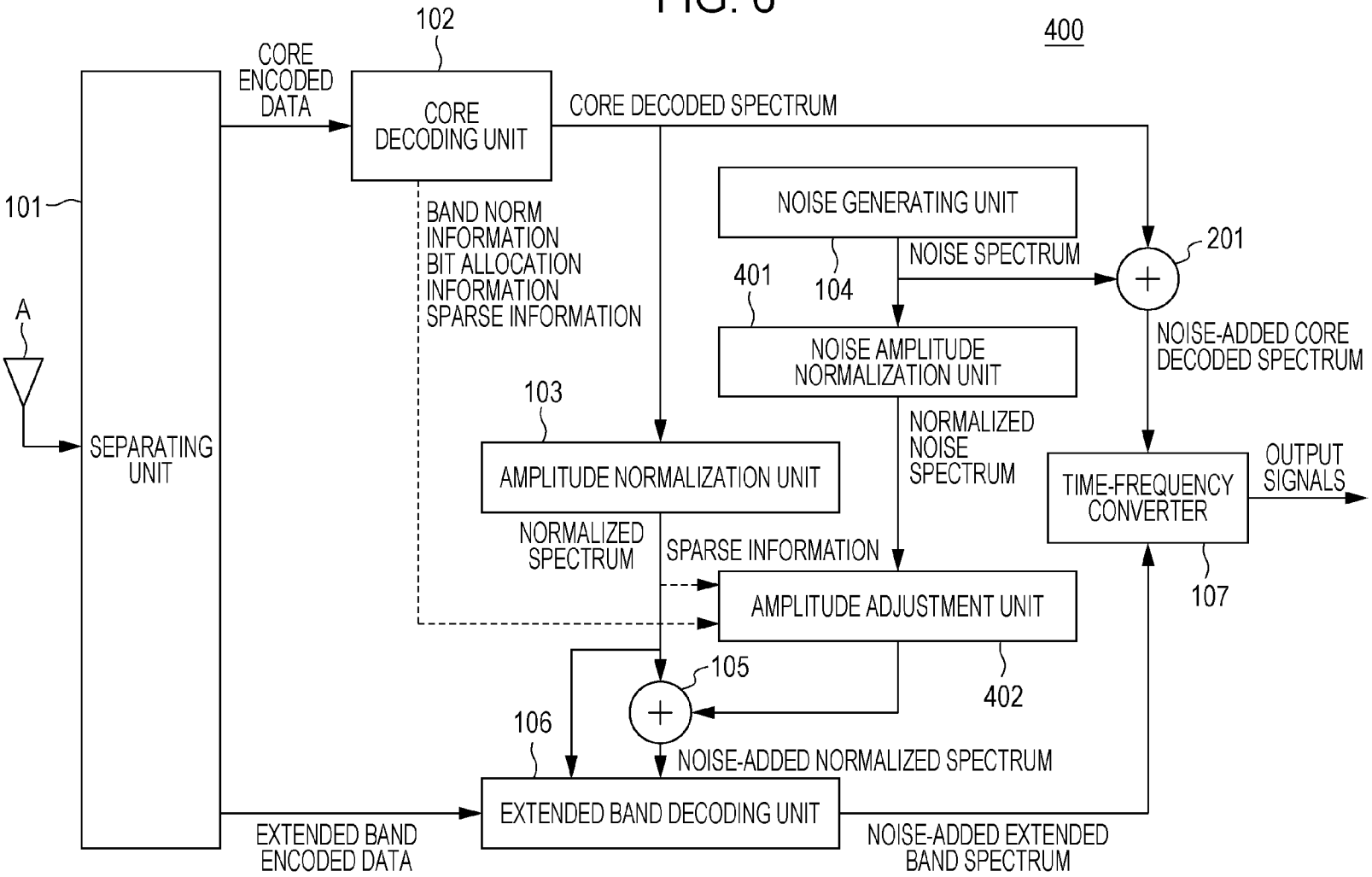
FIG. 6 is a configuration diagram of a decoding device according to a fourth embodiment of the present disclosure.
Figure 9:
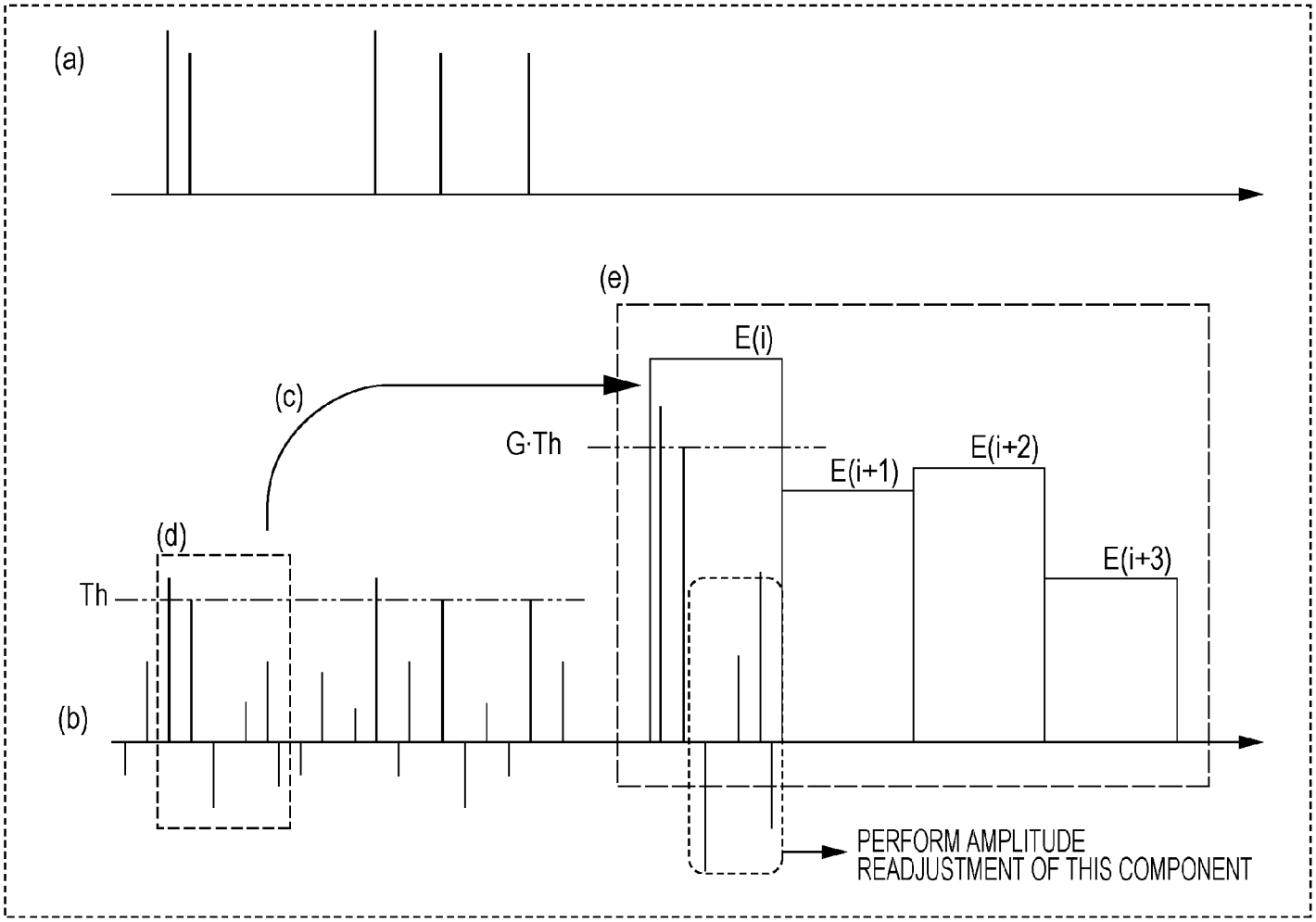
FIG. 9 is an explanatory diagram illustrating operations of an amplitude readjusting unit of another decoding device according to the fourth embodiment of the present disclosure.

Blocks having the same configuration as FIG. 6 are denoted by the same reference numerals. The difference between the decoding device 410 and the decoding device 400 according to the fourth embodiment is that the decoding device 410 according to the present embodiment has an amplitude readjustment unit 403. Other components are basically the same as in the fourth embodiment, so description will be omitted. The amplitude readjustment unit 403 generates an extended band using the core decoded spectrum to which noise is added, and thereafter readjusts the amplitude of the added noise component. This readjustment can be performed as illustrated in FIG. 9. In FIG. 9, (a) represents the normalized spectrum output from the amplitude normalization unit 103, and (b) represents the noise-added normalized spectrum output from the first addition unit 105. As indicated by (c), the noise-added normalized spectrum is shifted to an extended band based on lag information, thereby generating an extended band spectrum by multiplying by gain. In (b), only the i'th band that is the lowest band in the extended band is illustrated. E(i) in this drawing represents the band norm information (band energy) of the i'th band, and the portion surrounded by the dotted line (d) is the noise-added normalized spectrum specified by lag information (specified by the extended band decoding unit 106). A corresponding extended band (the i'th band here) is multiplied by a suitable gain G in copied. The portion surrounded by the dotted line (e) is the extended band. Amplitude readjustment of the added noise component is performed as follows.

First, a threshold value Th is decided. The Th is a value that is half of the greatest amplitude of the normalized spectrum, for example. In a case where the amplitude of the normalized spectrum is restricted to a particular amplitude or above, the smallest amplitude value of the normalized spectrum may be Th. Alternatively, an average amplitude value of normalized spectrums that have a value may be used. Again, an average amplitude value of the added noise spectrums may be used. Moreover, these values may be values multiplied by a constant and adjusted.

The Th and the amplitude thereof in a case where the smallest amplitude of the normalized spectrum is used as Th is illustrated in (b) by a two-dot broken line. Components having an amplitude smaller than this Th are defined as noise components. Next, the gain G obtained by decoding the extended band encoded data is multiplied by Th and G·Th is calculated.

Next, with regard to the spectrum of the i'th band generated by band extension, a spectrum having an amplitude smaller than the threshold value G·Th is selected and defined as noise component, and the noise component energy of the i'th band is calculated (set as EN(i)).

Next, a SEN(i), which is EN(i) smoothed in the time axial direction by the following Expression (8) is obtained, $$SEN(i)=\sigma\times pSEN(i)+(1-\sigma)\times EN(i) \quad (8)$$

where σ represents a smoothing coefficient that is a constant 0 to 1 and close to 1, and pSEN(i) represents SEN(i) from one frame earlier.

The noise component is then multiplied by √SEN(i)/√EN(i), so that the energy of the noise spectrum of the i'th band is SEN(i).

In the same way, amplitude readjustment is performed on noise components of the bands of other extended bands. Further, in a case where there is variance in the bands SEN(i) of other extended bands, amplitude readjustment to do away with that variance may be performed. Specifically, an average value AEN of EN(i) in all bands of the extended band is obtained, the noise component of each band is multiplied by AEN/EN(i) so that the EN(i) of all bands is equal to AEN, and thereafter the inter-frame smoothing processing is performed.

Note that the order in which the processing of aligning the energy of the noise component in each band and the inter-frame smoothing processing is optional, and that only one or the other may be performed.

Fifth Embodiment

Embodiments of decoding devices have been described in the first through fourth embodiments. The present disclosure is also applicable to encoding devices. Hereinafter, the configuration of an encoding device 500 according to a fifth embodiment of the present disclosure will be described with reference to FIG. 10.

Figure 10:
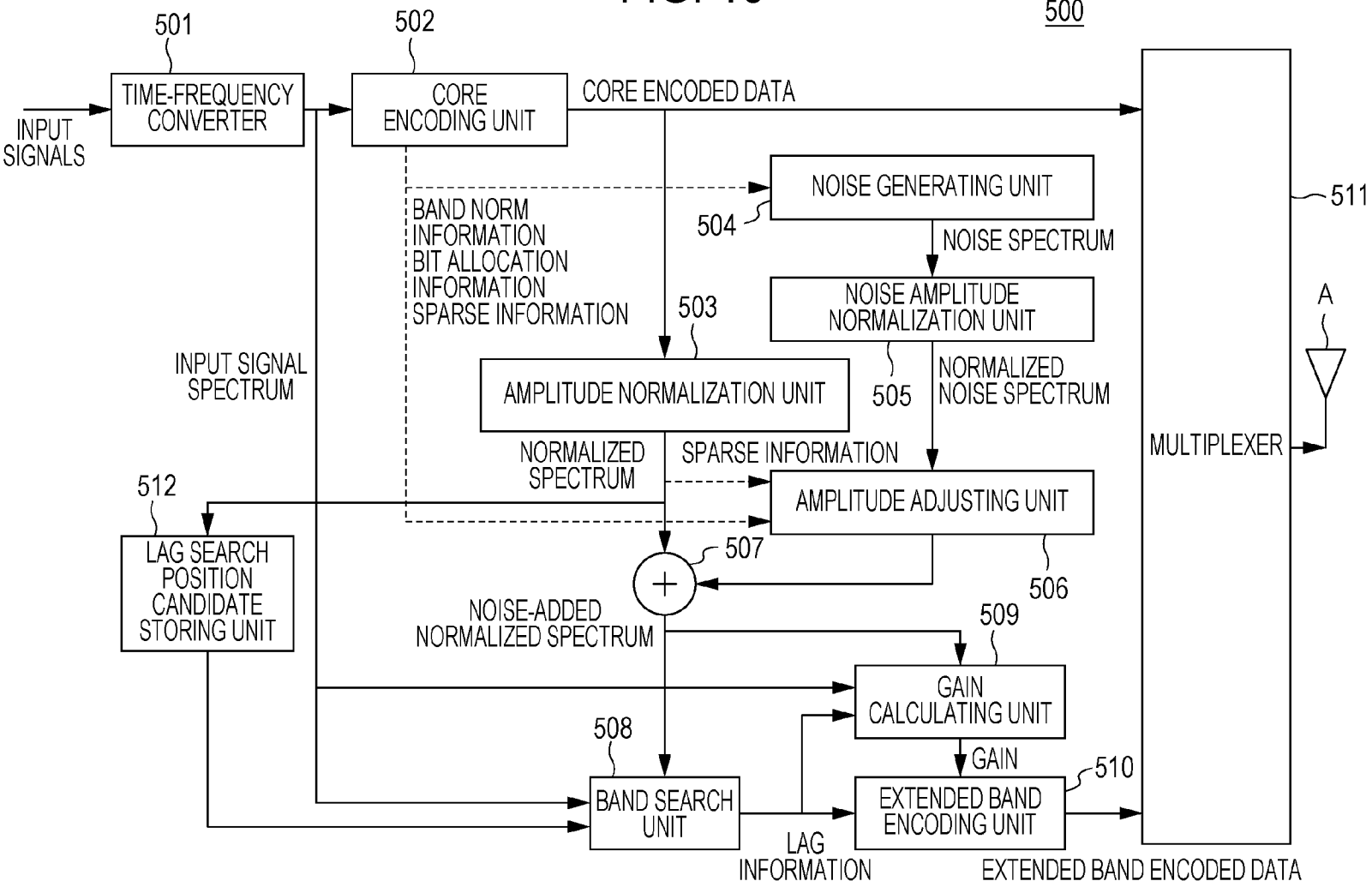
FIG. 10 is a configuration diagram of a decoding device according to a fifth embodiment of the present disclosure.
Figure 11:
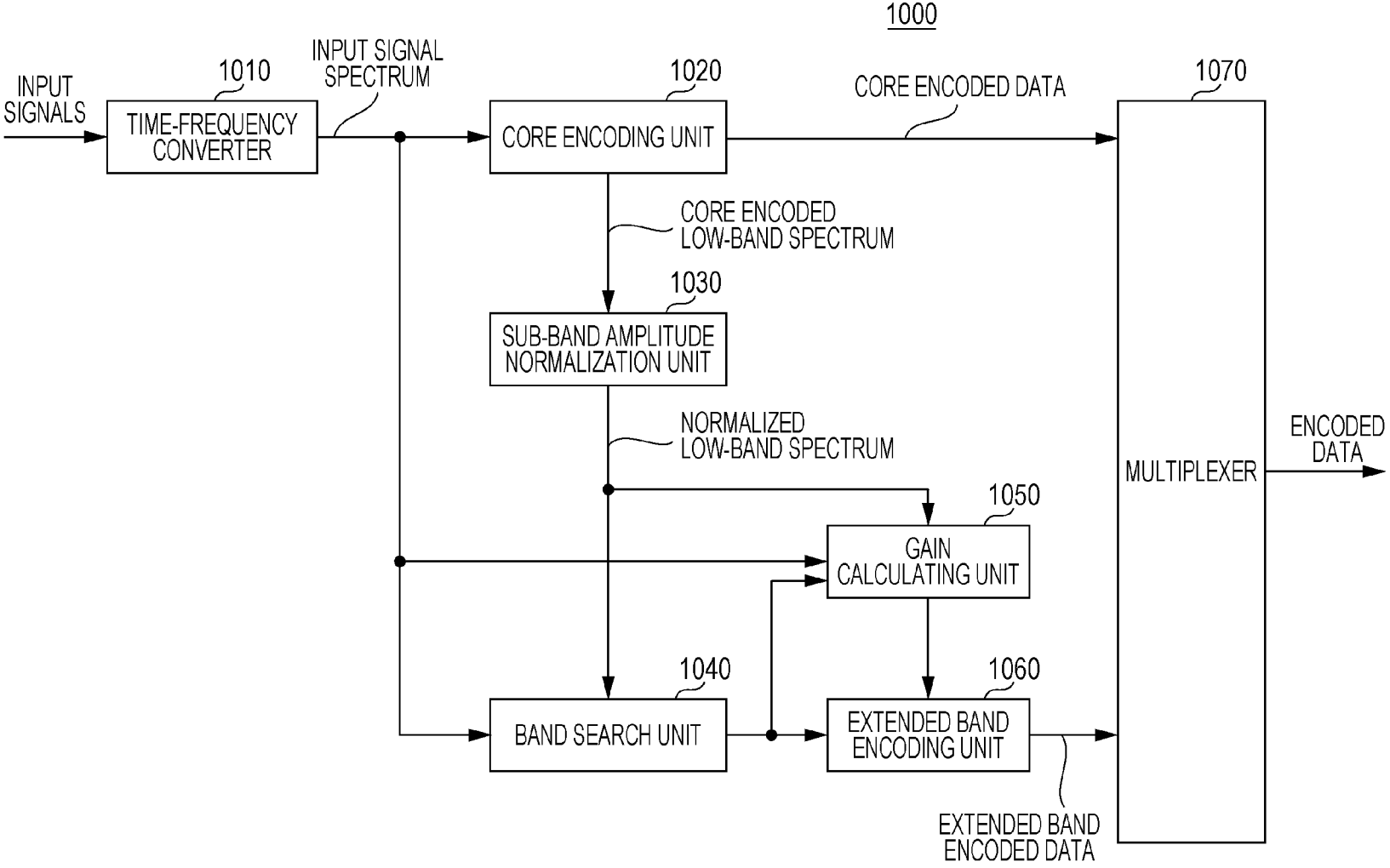
FIG. 11 is a configuration diagram of an encoding device according to conventional art.
Figure 12:
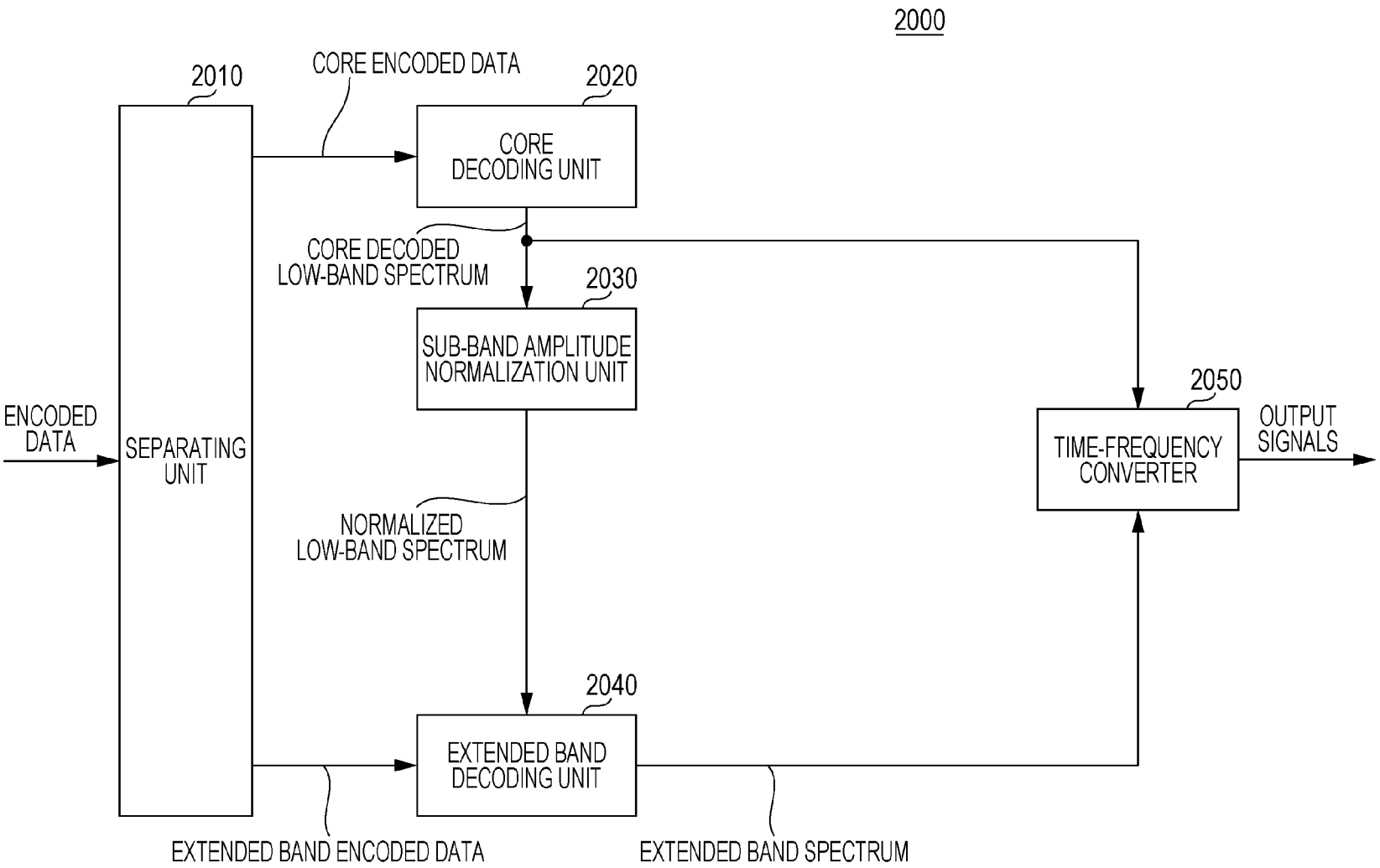
FIG. 12 is a configuration diagram of a decoding device according to conventional art.
Figure 13:
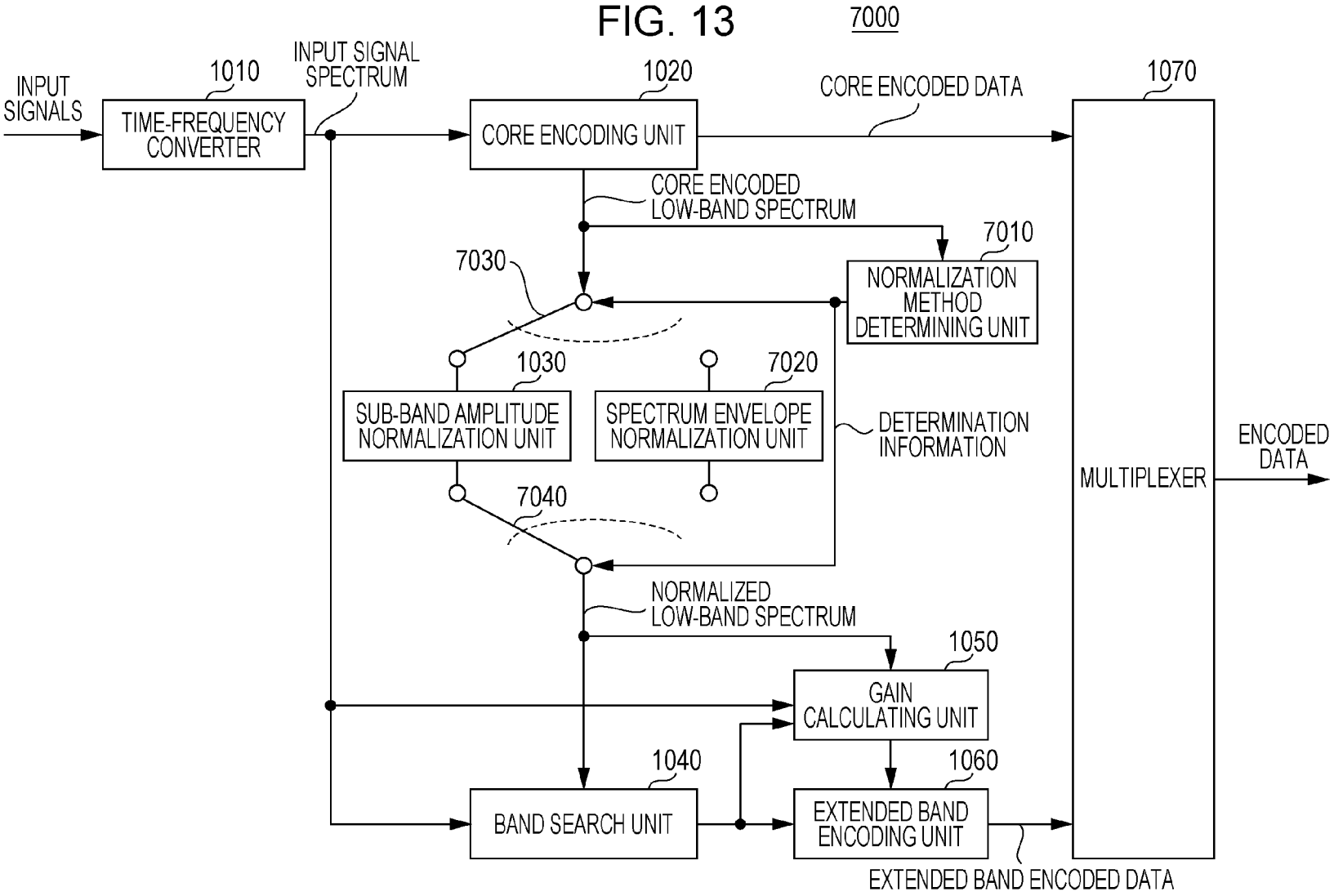
FIG. 13 is a configuration diagram of an encoding device according to conventional art.

FIG. 10 is a block diagram illustrating the configuration of an encoding device according to a fifth embodiment. An encoding device 500 illustrated in FIG. 10 is configured including a time-frequency converter 501, a core encoding unit 502, an amplitude normalization unit 503, a noise generating unit 504, a noise amplitude normalization unit 505, an amplitude adjusting unit 506, a first addition unit 507, a band search unit 508, a gain calculating unit 509, an extended band encoding unit 510, a multiplexer 511, and a lag search position candidate storing unit 512. An antenna A is connected to the multiplexer 511.

The time-frequency converter 501 converts input signals, which are time-region audio signals and so forth, into frequency-region signals, and outputs the obtained input signal spectrum to the core encoding unit 502, band search unit 508, and gain calculating unit 509.

The core encoding unit 502 encodes the low-band spectrum of the input signal spectrum and generates core encoded data. An example of encoding is CELP coding and transform coding. The core encoding unit 502 outputs the core encoded data to the multiplexer 511. The core encoding unit 502 decodes the core encoded data and outputs the obtained core decoded spectrum to the amplitude normalization unit 503. The operations of the amplitude normalization unit 503, noise generating unit 504, and noise amplitude normalization unit 505, and amplitude adjusting unit 506 are the same as those described in the third and fourth embodiments, so description will be omitted.

The lag search position candidate storing unit 512 stores positions (frequencies) of components where the amplitude of the normalized spectrum is not zero, as candidate positions for band search. The lag search position candidate storing unit 512 then outputs the stored candidate position information to the band search unit 508.

The first addition unit 507 adds the normalized spectrum and the normalized noise spectrum of which the amplitude has been adjusted, and generates a noise-added normalized spectrum. The first addition unit 507 then outputs the noise-added normalized spectrum to the band search unit 508 and gain calculating unit 509.

The band search unit 508, gain calculating unit 509, and extended band encoding unit 510 perform processing of encoding the high-band spectrum of the input signal spectrum.

The band search unit 508 searches for a particular band where the correlation between the high-band spectrum and the noise-added normalized spectrum is largest in the input signal spectrum. The search is performed by selecting candidates from the candidate positions input from the lag search position candidate storing unit 512 where the correlation is largest. The band search unit 508 then outputs lag information, which is information indicating a search particular band, to the gain calculating unit 509 and extended band encoding unit 510.

The gain calculating unit 509 calculates the gain between the high-band spectrum at a particular band and the noise-added normalized spectrum, and outputs to the extended band encoding unit 510.

The extended band encoding unit 510 encodes the lag information and gain, and generates extended band encoded data. The extended band encoding unit 510 then outputs the extended band encoded data to the multiplexer 511. The multiplexer 511 multiplexes the core encoded data and the extended band encoded data, and transmits via the antenna A.

Thus, according to the present embodiment, search (lag search, similarity search) of a high-band spectrum is performed using a noise-component-added spectrum, so spectrum form matching precision can be improved.

Note that while FIG. 10 that illustrates the present embodiment shows a configuration where the third embodiment and fourth embodiment, that are embodiments of a decoding device, have been combined, the configuration may correspond to the first, second, third, or fourth embodiments. Further, the configuration may correspond to a later-described sixth embodiment.

Sixth Embodiment

Figure 14:
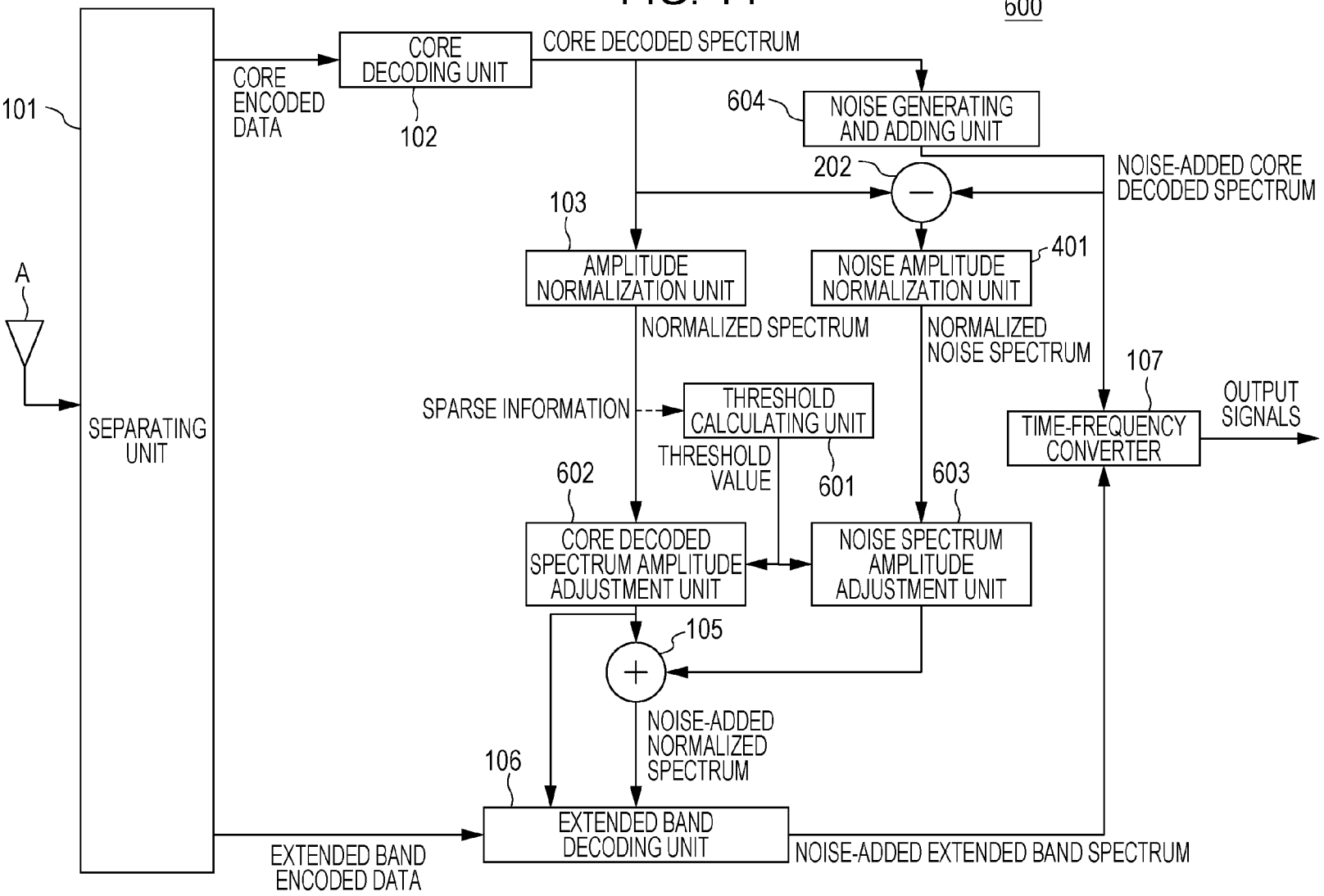
FIG. 14 is a configuration diagram of a decoding device according to a sixth embodiment of the present disclosure.

Next, the configuration of a decoding device 600 according to a sixth embodiment of the present disclosure will be described with reference to FIG. 14. Blocks having the same configuration as those of the decoding device 400 in FIG. 6 illustrating the fourth embodiment are denoted by the same reference numerals. The difference between the decoding device 600 according to the present embodiment and the decoding device 400 is that the decoding device 600 anomaly detection processing request signal newly includes a threshold value calculating unit 601 and a core decoded spectrum amplitude adjustment unit 602. Further, the amplitude adjusting unit 402 has been replaced by a noise spectrum amplitude adjustment unit (second amplitude adjustment unit) 603.

The decoding device 600 according to the present embodiment further has a noise generating and adding unit 604 and the subtraction unit 202 instead of the noise generating unit 104; this is a configuration for generating and adding the noise spectrum so as to fill in the zero spectrum component of the core decoded spectrum, described in the other example of the second embodiment. Other components are basically the same as in the fourth embodiment, so description will be omitted. The threshold value calculating unit 601 uses sparse information of the normalized spectrum to calculate the threshold value Th of spectrum intensity, to distinguish between noise component and non-noise component. A specific calculation method will be described later. Note that sparse information of the core decoded spectrum may be used instead of sparse information of the normalized spectrum.

The threshold value calculating unit 601 then outputs the threshold value to the core decoded spectrum amplitude adjustment unit 602 and noise spectrum amplitude adjustment unit 603.

Figure 15A:
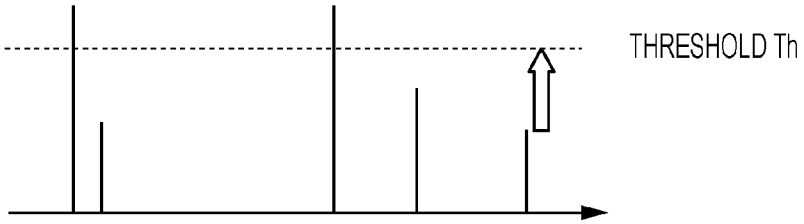
FIGS. 15A and 15B are explanatory diagrams illustrating the operations of a core decoded spectral amplitude adjusting unit according to the sixth embodiment of the present disclosure.

The core decoded spectrum amplitude adjustment unit 602 adjusts the amplitude of the normalized spectrum so that the non-zero component of the normalized spectrum is larger than the threshold value. Specifically, the overall normalized spectrum is raised by providing each spectrum with a certain offset, or amplifying by a certain rate, so that the smallest value of the non-zero component in the normalized spectrum is larger than the threshold value, as illustrated in FIG. 15A.

Figure 15B:
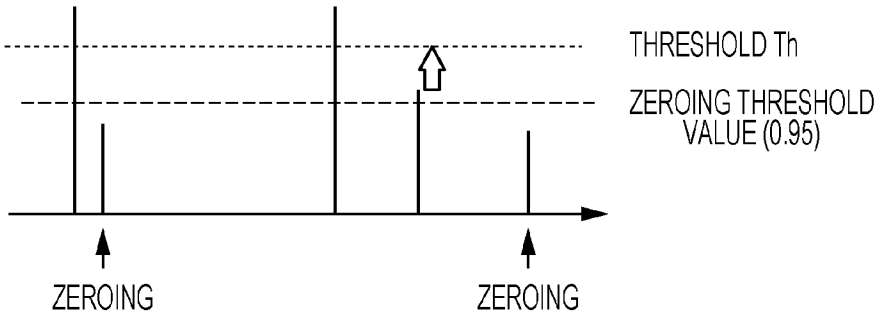

One example of an amplifying method is scaling by Y=aX+Th where the amplitude after amplification is Y, before amplification is X, and the threshold value is Th (note that a=(Xmax−Th)/Xmax, where Xmax is the largest value that X can assume). Alternatively, the smallest of a spectrum having a certain intensity or larger (called "zeroing threshold value") may be made to be larger than the threshold value, as illustrated in FIG. 15B. For example, in a case where the range of a normalized spectrum is normalized from 0 to 10, the zeroing threshold value is set to 0.95, and the smallest of a spectrum having 0.95 or higher may be made larger than the threshold value Th. In this case, spectrums smaller than 0.95 are zeroed. That is to say, in this case, spectrums of the zeroing threshold value or higher are non-zero components, and spectrums smaller than the zeroing threshold value are zero components.

While fixed values may be used as the zeroing threshold value as described above, a variable value that varies in accordance with other variables may be used as the zeroing threshold value. For example, zeroing threshold value=threshold value Th×α (where α is a constant, α=¼ for example) may be used. Also, an upper limit value or lower limit value may be used in conjunction as the zeroing threshold value. For example, in a case where the zeroing threshold value is 0.9 or lower, 0.9 may be used as the zeroing threshold value. The normalized spectrum of which the amplitude has been adjusted is then output to the first addition unit 105.

The noise spectrum amplitude adjustment unit 603 adjusts the amplitude of the normalized noise spectrum so that the largest value of the normalized noise spectrum is equal to or smaller than the threshold value. Specifically, in a case where the largest value of the normalized noise spectrum is smaller than the threshold value, the largest value of the normalized spectrum is set to the threshold value or lower by providing each spectrum with a certain offset, or amplifying by a certain rate. In a case where the largest value of the normalized noise spectrum is larger than the threshold value, a negative offset is applied, which is to say subtraction (clipping), or amplification by a negative rate, i.e., attenuation, is performed. This adjustment is synonymous to normalizing the normalized noise spectrum by a threshold value. The normalized noise spectrum of which the amplitude has been adjusted in output to the first addition unit 105. The first addition unit 105 adds the normalized spectrum of which the amplitude has been adjusted and the normalized noise spectrum of which the amplitude has been adjusted, and outputs to the extended band decoding unit 106 as a noise-added normalized spectrum.

The following is a method of obtaining the threshold value. The threshold value serves to separate between noise component and non-noise component. The threshold value Th can be obtained by the following Expression (9), using the sparseness Sp in Expression (2). The a is a constant, and is set to 4, for example, in the present embodiment.

$$Th = a(1 - Sp) = a\left(1 - \frac{Nz}{Lb}\right) \tag{9}$$

Note that the threshold value Th can be obtained using the following Expression (10) instead of Expression (9) using Nz, $$Th = a \times \frac{Np}{Lb} \tag{10}$$

where Np represents the number of spectrums that are not zero.

Also, an upper limit or lower limit may be used along with these as the threshold value Th. That is to say, according to Expression (9), the larger the sparseness Sp is, that is to say, the more discrete the pulse stream is with more zero component, the lower the noise property is and the lower the threshold value Th is. Conversely, the smaller the sparseness Sp is, that is to say, the denser the pulse stream is with less zero component, the higher the noise property is and the higher the threshold value Th is. When the sparseness Sp is large (the threshold value Th is low), the amplitude of the noise spectrum adjusted at the noise spectrum amplitude adjustment unit 603 is suppressed to a low level, and a noise spectrum with a small amplitude is added at the addition unit 105. That is to say, the noise property of the normalized spectrum signals is low, so the amplitude of the added noise spectrum is small, to maintain this property.

Conversely, when the sparseness Sp is small (the threshold value Th is high), the amplitude of the noise spectrum adjusted at the noise spectrum amplitude adjustment unit 603 is large, and a noise spectrum with a large amplitude is added at the addition unit 105. That is to say, the noise property of the normalized spectrum signals is high, so the amplitude of the added noise spectrum is large, to maintain this property.

Note that one threshold value has been used in common in the present embodiment between the core decoded spectrum amplitude adjustment unit (first amplitude adjustment unit) 602 and noise spectrum amplitude adjustment unit (second amplitude adjustment unit) 603. However, the core decoded spectrum amplitude adjustment unit 602 and noise spectrum amplitude adjustment unit 603 may use different threshold values. This is because, while the threshold value serves to separate noise component and non-noise component, the noise property that the low-band spectrum originally included in the normalized spectrum has, and the noise property that the generated noise spectrum has may be different properties, and using independent standards for each instead of using the same standard for both can raise the image quality in such cases. For example, setting the threshold used with the core decoded spectrum amplitude adjustment unit 602 to be higher than the threshold used with the noise spectrum amplitude adjustment unit 603 enables the component contained in the normalized spectrum, that is the original signal, to be enhanced more.

Although just sparseness has been used in Expression (9) to obtain the threshold value, band norm information and bit allocation information may be combined, or used alone, as in the third embodiment and fourth embodiment. For example, using bit allocation information in conjunction is conceivable in the following case.

Increasing bit allocation enables the number of pulses to be increased, so lower amplitude pulses also are encoded, and the number of quantized pulses increases. As a result, the sparseness decreases. That is to say, the sparseness depends not only on the characteristics of the signals to be encoded, but also on the allocated bit count. Accordingly, in a case where the number of allocated bits changes greatly, the relationship between sparseness and the threshold value may be adjusted to correct the influence due to change in bit allocation.

While the configuration in the other example of the second embodiment has been used for the noise generating and adding unit 604 in the present embodiment, the noise generating unit 104 of the first embodiment, the noise generating unit 104 and second addition unit 201 of the second embodiment, and the noise generating unit 301 and second addition unit 201 of the third embodiment may be used instead.

According to the above-described decoding device 600, the amplitude of both the normalized spectrum and normalized noise spectrum can be adjusted, with regard to the amplitude of the normalized spectrum and the amplitude of the normalized noise spectrum, and these can be adjusted synchronously, so optimal noise can be added in accordance with the property of the normalized spectrum, and as a result, sound quality of output signals can be improved.

More specifically, the noise property of the normalized spectrum is enhanced, and a spectrum suitable for expressing a high-band frequency spectrum can be created, so the sound quality of the output signals of the decoding device based on the band extension model can be improved.

First Other Example of Sixth Embodiment

Figure 16:
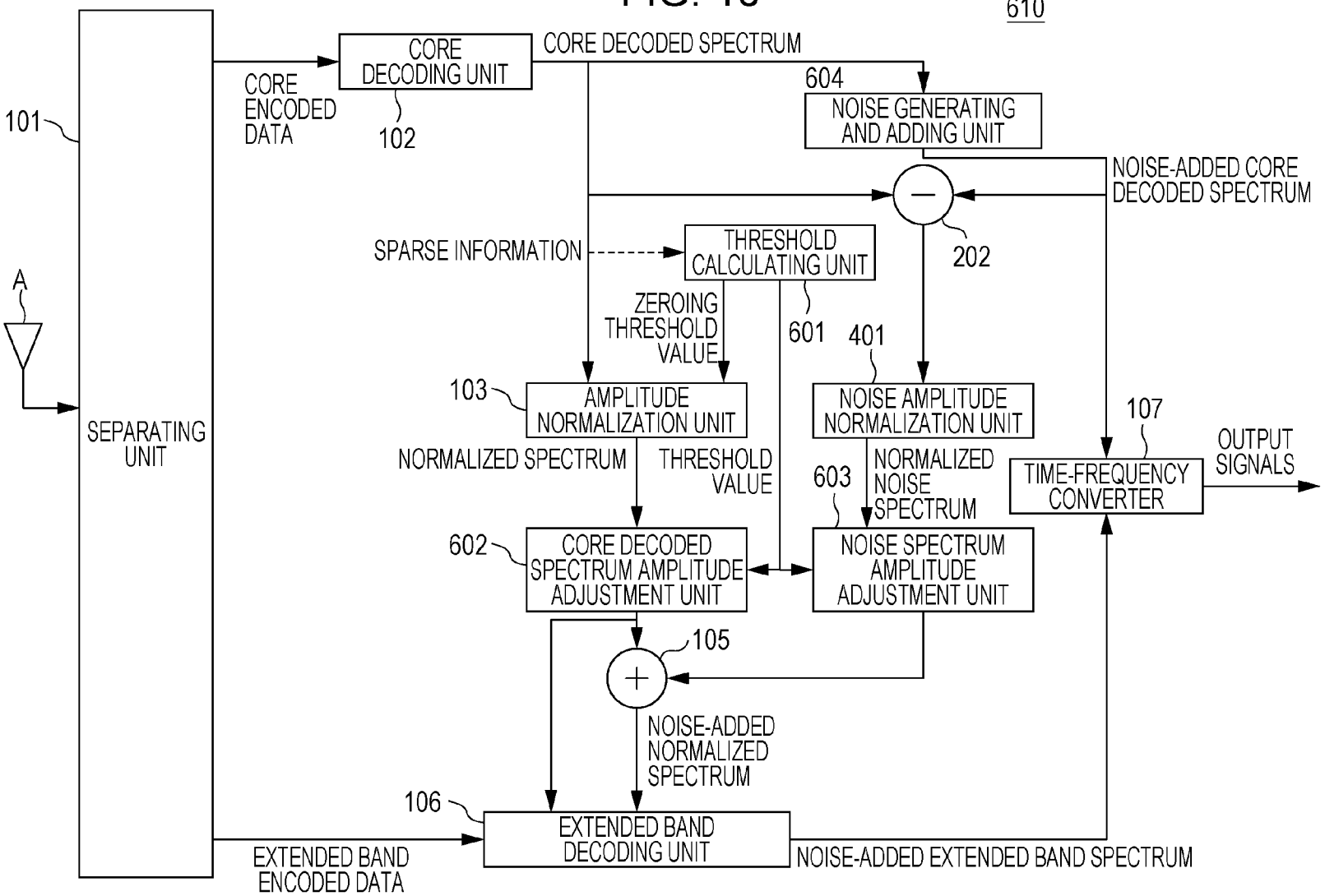
FIG. 16 is a configuration diagram of a decoding device according to a first other example of the sixth embodiment of the present disclosure.

Next, the configuration of a decoding device 610 according to a first other example of the sixth embodiment of the present disclosure will be described with reference to FIG. 16. Blocks having the same configuration as FIG. 14 are denoted by the same reference numerals. The difference between the decoding device 610 and the decoding device 600 according to the present embodiment primarily relates to the operations of the threshold value calculating unit 601.

The threshold value calculating unit 601 of the decoding device 610 according to the present embodiment takes the input sparse information as the sparse information of the core decoded spectrum, obtains the threshold value Th at the threshold value calculating unit 601 using Expression (9) and Expression (10) based on this sparse information, and also the zeroing threshold value is obtained using this threshold value Th, using a computation such as zeroing threshold value=threshold value Th×α, for example.

The threshold value calculating unit 601 then outputs the threshold value Th to the core decoded spectrum amplitude adjustment unit 602 and noise spectrum amplitude adjustment unit 603, and outputs the zeroing threshold value to the amplitude normalization unit (first amplitude normalization unit) 103.

The amplitude normalization unit 103 normalizes the core decoded spectrum, and sets spectrums smaller than the zeroing threshold value, or equal to or smaller than the zeroing threshold value, to zero (performs zeroing), and outputs.

Although the present embodiment has been described with the block that performs zeroing as being the amplitude normalization unit 103, but a separate block that performs zeroing may be provided either upstream or downstream of the amplitude normalization unit 103, or this may performed at the core decoded spectrum amplitude adjustment unit 602. In this case, the output destination of the zeroing threshold value may be the block that performs this zeroing.

Second Other Example of Sixth Embodiment

Figure 17:
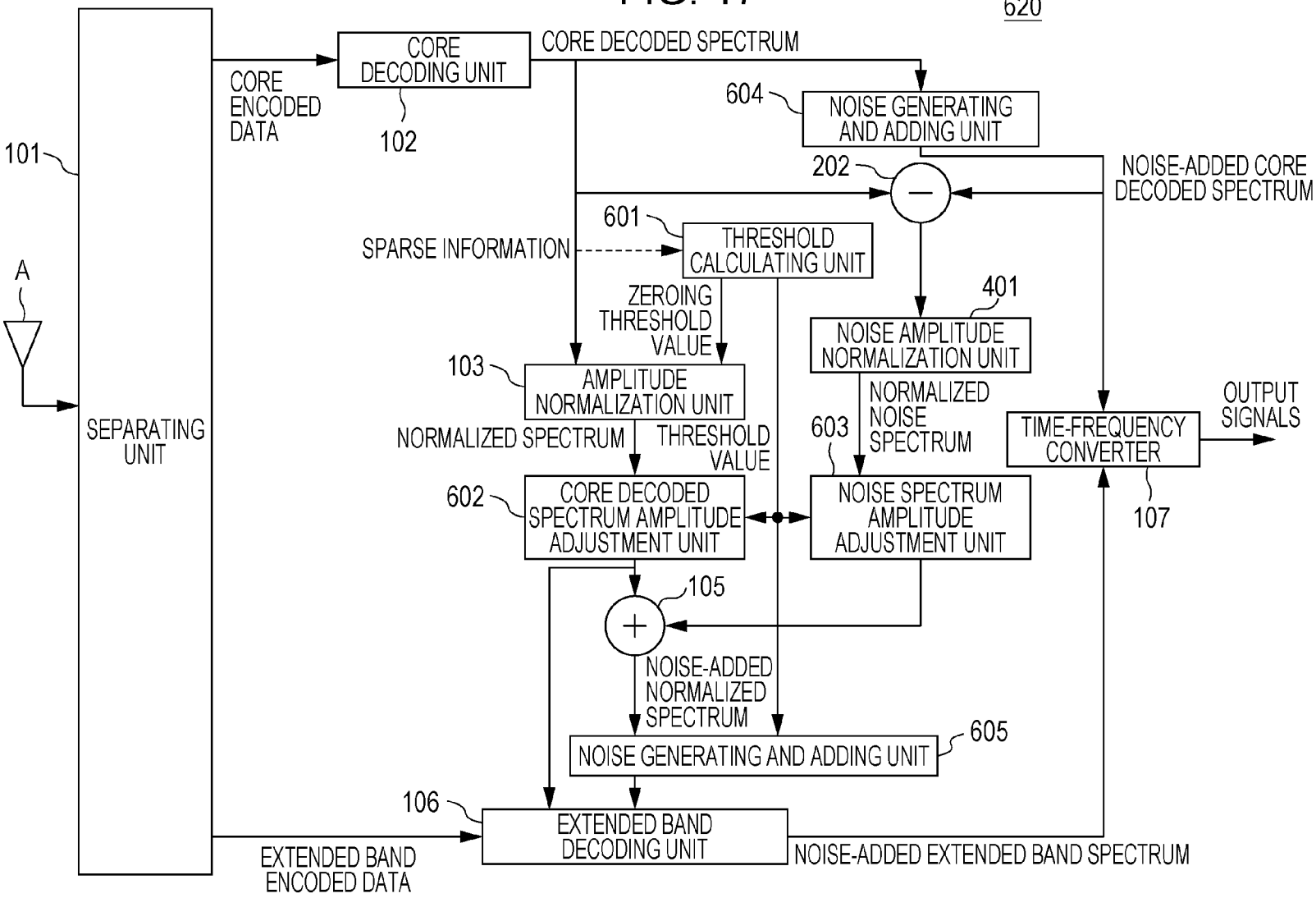
FIG. 17 is a configuration diagram of a decoding device according to a second other example of the sixth embodiment of the present disclosure.

Next, the configuration of a decoding device 620 according to a second other example of the sixth embodiment of the present disclosure will be described with reference to FIG. 17. Blocks having the same configuration as FIG. 16 are denoted by the same reference numerals. The difference between the decoding device 620 according to the present embodiment and the decoding device 600 or decoding device 610 is that a noise generating and adding unit 605 has been provided.

In the decoding device 600 and decoding device 610, the noise generating and adding unit 604 generates and adds the noise spectrum to fill in the zero spectrum component of the core decoded spectrum. That is to say, the configuration adds noise only to positions corresponding to the zero spectrum component of the core decoded spectrum, so ultimately there is no addition of noise to the spectral portions zeroed later by the amplitude normalization unit 103 or the like.

Accordingly, the noise generating and adding unit 605 is provided in the present embodiment to add noise to the spectral portions that have been zeroed. The noise generating and adding unit 605 detects a zero spectrum in the noise-added normalized spectrum output from the first addition unit 105 and generates and adds random noise to fill this in. The largest value of the amplitude to be added is controlled as described above, so the threshold value generated by the threshold value calculating unit 601 may be output to the noise generating and adding unit 605, this threshold value being used to decide the largest value of amplitude. An upper limit value may be used in conjunction, separately from the threshold value.

Note that instead of detecting zero spectrums in the noise-added normalized spectrum, an arrangement may be made where information of zeroed spectrums is received from blocks that perform zeroing, e.g., the amplitude normalization unit 103, with noise being added to the positions of zeroed spectrums.

Also, although description has been made in the present embodiment that the noise generating and adding unit 605 is provided downstream of the first addition unit 105, an arrangement may be made instead where the noise generating and adding unit 605 is provided between the noise spectrum amplitude adjustment unit 603 and the first addition unit 105, or between the noise amplitude normalization unit 401 and noise spectrum amplitude adjustment unit 603. In this case, information of the zeroed spectrums is received from the block that has performed the zeroing, and noise is added to the positions of the zeroed spectrums.

Seventh Embodiment

Figure 18:
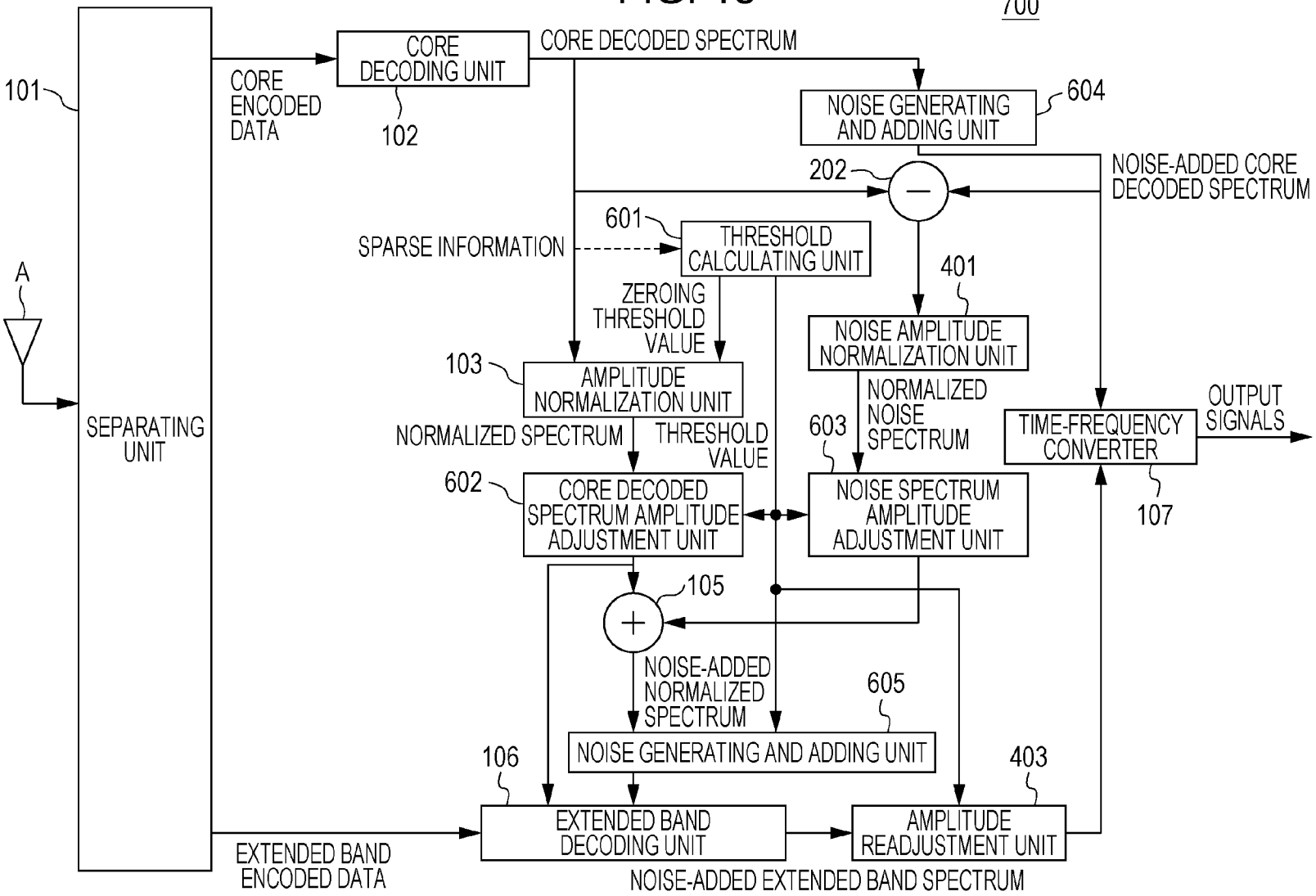
FIG. 18 is a configuration diagram of a decoding device according to a seventh embodiment of the present disclosure.

Next, the configuration of a decoding device 700 according to a seventh embodiment of the present disclosure will be described with reference to FIG. 18. The decoding device 700 according to the present embodiment is the decoding device 620 according to the second other example of the sixth embodiment, to which the amplitude readjustment unit 403 described in the other example of the fourth embodiment has been added. In accordance with this, the threshold value Th calculated at the threshold value calculating unit 601 is also output to the amplitude readjustment unit 403. Other configurations are the same as the second other example of the sixth embodiment, so description will be omitted.

Figure 19:
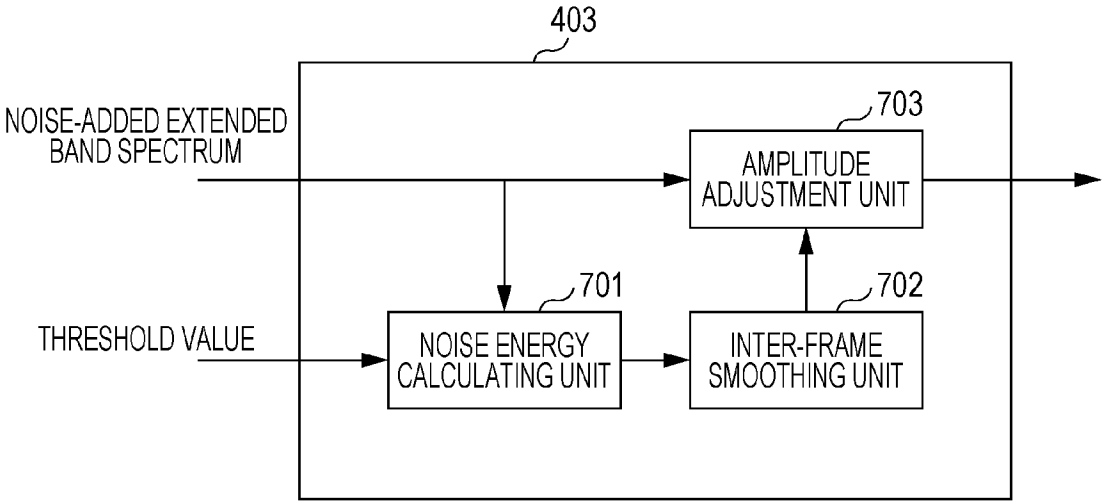
FIG. 19 is a configuration diagram of an amplitude readjusting unit of the decoding device according to the seventh embodiment of the present disclosure.

The noise-added normalized spectrum generated at the extended band decoding unit 106 is output to the amplitude readjustment unit 403. The operations of the amplitude readjustment unit 403 are basically the same as the other example of the fourth embodiment, so description will be made below primarily regarding the relationship as to the second other example of the sixth embodiment. The amplitude readjustment unit 403 will be described in blocks according to each function. The amplitude readjustment unit 403 is made up of a noise energy calculating unit 701, an inter-frame smoothing unit 702, and an amplitude adjustment unit 703, as illustrated in FIG. 19.

The noise energy calculating unit 701 calculates the energy of the added noise spectrum for each sub-band. The added noise spectrum can be detected and separated by using the threshold value Th according to the sixth embodiment. The extended band decoding unit 106 multiples the noise-added normalized spectrum identified by lag information decoded from the extended band encoded data, by the gain decoded from the same extended band encoded data, thereby generating a noise-added extended band spectrum. Accordingly, the value obtained by multiplying the threshold value Th in the sixth embodiment by the gain is the threshold value for noise component determination in the noise-added extended band spectrum. That is to say, the threshold value obtained by the threshold value calculating unit 601 is multiplied by the gain to obtain the noise component determination threshold value, and components less than (equal to or less than) the noise component determination threshold value are determined to be noise component in each sub-band. The gain is encoded for each sub-band, so the noise component determination threshold value is calculated for each sub-band.

The energy of the noise spectrum of each sub-band is then output to the inter-frame smoothing unit 702. The inter-frame smoothing unit 702 uses the energy of the noise spectrum for each sub-band that has been received to perform smoothing processing, so that the change in energy of noise spectrums is smooth among sub-bands. The smoothing processing can be performed using known inter-frame smoothing processing.

For example, the inter-frame smoothing processing can be performed according to the following Expression (11), $$ESc=\sigma\times Ec+(1-\sigma)\times EScp \tag{11}$$

where ESc represents the energy of the noise spectrum after smoothing processing, Ec represents the energy of the noise spectrum before smoothing processing, EScp represents the energy of the noise spectrum after smoothing processing in the previous frame, and σ represents a smoothing coefficient ($0<\sigma<1$). The closer the value of σ is to 0, the stronger the smoothing is. Around 0.15 is suitable.

In a case where the signals of the current frame have suddenly attenuated in comparison with the signals of the previous frame, applying strong smoothing will result in a high level of noise being maintained in an area where the signal levels should be lower, which is problematic. In order to handle such a situation, in a case where the sub-band energy information that is separately encoded is smaller than the sub band energy of the noise spectrum after smoothing processing in the previous frame (i.e., EScp), the value of σ is brought closer to 1 to make the smoothing processing weaker. For example, in a case where the EScp is smaller than 80% of the decoded sub-band energy in the current frame, σ is set to 0.15 to perform strong smoothing processing, while in a case where the EScp is 80% of the decoded sub-band energy in the current frame or larger (i.e., the decoded sub-band energy in the current frame is not sufficiently large as compared to the smoothed noise spectrum sub-band energy in the previous frame), σ is set to 0.8 to perform weak smoothing processing.

The amplitude adjustment unit 703 readjusts the amplitude of the noise portion of the input noise-added extended band spectrum using the ESc calculated by the inter-frame smoothing unit 702. The readjustment method is the same as that described in the other example of the fourth embodiment. That is to say, (√ESc/√Ec) is multiplied as a scaling coefficient, as described in the other example of the fourth embodiment. In a case where the change in energy due to scaling is large, there is a possibility that the energy of the overall decoded signals including other than the noise component will markedly deviate from the original magnitude. In this case, having a scaling coefficient of √(√ESc/√Ec) enables change in the scaling coefficient to be non-linearly suppressed, so adverse effects on the energy of the overall decoded signals due to scaling can be reduced.

According to the present embodiment described above, the noise component of the high-band signals composited by the band extension processing is smoothed in the temporal direction, and processing to suppress change as to amplitude change is performed, so the level of the noise component of the decoded signals is stabilized, and the image quality for listening can be improved. Using this combined with the noise-added normalized spectrum generating method according to the present embodiment does away with the need for separate encoding and transmission of noise component determination information, so efficient noise component addition and stabilization can be realized.

IN CONCLUSION

The decoding device and encoding device according to the present disclosure has been described with reference to the first through seventh embodiments. The decoding device and encoding device according to the present disclosure are concepts that may be in the form of half-completed products or on the level of parts, such as system boards or semiconductor devices, or on the level of having the form of completed products such as terminal devices or base station devices. In a case where the decoding device and encoding device according to the present disclosure are in the form of half-completed products or on the level of parts, these can be made to be on the level of having the form of completed products by combining with an antenna, DA/AD converter, amplifier, speaker, microphone, and so forth.

The block diagrams of FIGS. 1 through 8, FIG. 10, FIG. 14, and FIGS. 16 through 19, represent dedicated-design hardware configurations and operations (methods), and also include cases where programs that execute the operations (method) of the preset disclosure are installed in general hardware and executed by a processor. Examples of electronic calculators serving as general-purpose hardware include personal computers, various types of mobile information terminals such as smartphones, and cellular phones and the like.

The dedicated-design hardware is not restricted to the completed product level such as cellular phones and landline phones (consumer electronics), and includes those in the form of half-completed products or on the level of parts, such as system boards, semiconductor devices, and so forth.

The decoding device and encoding device according to the present disclosure is applicable to devices relating to recording, transmission, and playback of audio signals and music signals.

What is claimed is:

1. A decoding device, comprising:

a separator that separates first encoded data, where a spectrum including a low-band spectrum of audio signals has been encoded, and second encoded data where a high-band spectrum of a higher band than the low-band spectrum has been encoded, based on the first encoded data;

a first decoder that decodes the first encoded data and generates a first decoded spectrum;

a first amplitude normalizer that divides the amplitude of the first decoded spectrum into a plurality of sub-bands, normalizes the spectrum of each sub-band by the largest value of the amplitude of the first decoded spectrum within each sub-band, and generates a normalized spectrum;

a first adjuster configured to adjust an amplitude of a normalized noise spectrum so that a largest value of the normalized noise spectrum is equal to or smaller than a threshold value, or configured to adjust an amplitude of a normalized noise spectrum using scaling a maximum amplitude of the normalized noise spectrum using a threshold;

an amplitude adjuster configured to adjust an amplitude of the normalized spectrum regarding a non-zero content of the normalized spectrum by removing the non-zero content smaller than a threshold value, or configured to adjust the first decoded spectrum or the normalized spectrum by removing a low amplitude using the threshold;

an adder that adds an adjusted noise spectrum to an adjusted normalized spectrum or an adjusted decoded spectrum and generates a noise-added normalized spectrum;

a second decoder that decodes the second encoded data using the noise-added normalized spectrum, and generates a second noise-added spectrum; and a converter that performs frequency-time conversion regarding a spectrum generated by concatenating a spectrum based on the first decoded spectrum and a spectrum based on the second noise-added spectrum.

2. The decoding device according to claim 1, wherein the converter performs frequency-time conversion regarding a spectrum generated by concatenating a spectrum based on a first noise-added decoded spectrum obtained by adding the noise spectrum to the first decoded spectrum, and the second noise-added spectrum.

3. The decoding device according to claim 1, wherein the amplitude of the noise spectrum is based on at least one of bit allocation information of the first decoded spectrum, and sparse information indicating a degree of sparseness of the first decoded spectrum.

4. The decoding device according to claim 1, wherein the amplitude adjuster zeroes the non-zero content of the normalized spectrum based on a zeroing threshold value to obtain a zero content separated from the non-zero content of the normalized spectrum, the zeroing threshold value being calculated using the threshold value.

5. The decoding device according to claim 4, further comprising:

a noise adder that adds the noise spectrum to a position of the zero content that has been zeroed.

6. The decoding device according to claim 1, further comprising:

an amplitude readjuster that applies a smoothing process on a noise component of the second noise-added spectrum.

7. The decoding device according to claim 6, wherein the amplitude readjuster smoothens an energy change between frames of the second noise-added spectrum using an energy of the noise component of the second noise-added spectrum calculated based on a threshold value, and adjusts an amplitude of the noise component of the second noise-added spectrum using a scaling coefficient representing a ratio between a noise component energy of the noise component of the second noise-added spectrum and an energy of the noise component of the second noise-added spectrum to be obtained after smoothing.

8. A decoding method, comprising:

separating first encoded data, where a spectrum including a low-band spectrum of audio signals has been encoded, and second encoded data where a high-band spectrum of a higher band than the low-band spectrum has been encoded, based on the first encoded data;

decoding the first encoded data and generating a first decoded spectrum;

dividing the amplitude of the first decoded spectrum into a plurality of sub-bands, normalizing the spectrum of each sub-band by the largest value of the amplitude of the first decoded spectrum within each sub-band, and generating a normalized spectrum;

adjusting an amplitude of a normalized noise spectrum so that a largest value of the normalized noise spectrum is equal to or smaller than a threshold value, or adjusting an amplitude of a normalized noise spectrum using scaling a maximum amplitude of the normalized noise spectrum using a threshold;

adjusting an amplitude of the normalized spectrum regarding a non-zero content of the normalized spectrum by removing the non-zero content smaller than a threshold value, or adjusting the first decoded spectrum or the normalized spectrum by removing a low amplitude using the threshold;

adding an adjusted noise spectrum to an adjusted normalized spectrum or an adjusted decoded spectrum and generating a noise-added normalized spectrum;

decoding the second encoded data using the noise-added normalized spectrum, and generating a second noise-added spectrum; and performing frequency-time conversion regarding a spectrum generated by concatenating a spectrum based on the first decoded spectrum and a spectrum based on the second noise-added spectrum.

9. The decoding method according to claim 8, wherein frequency-time conversion is performed regarding a spectrum generated by concatenating a spectrum based on a first noise-added decoded spectrum obtained by adding the noise spectrum to the first decoded spectrum, and the second noise-added spectrum.

10. The decoding method according to claim 8, wherein the amplitude of the noise spectrum is based on at least one of bit allocation information of the first decoded spectrum, and sparse information indicating a degree of sparseness of the first decoded spectrum.

11. The decoding method according to claim 8, wherein a zero content of the normalized spectrum is obtained by zeroing based on a zeroing threshold value to separate the zero content and a non-zero content of the normalized spectrum, the zeroing threshold value being calculated using the threshold value.

12. The decoding method according to claim 11, further comprising:

adding the adjusted normalized noise spectrum to a position of the zero content that has been zeroed.

13. The decoding method according to claim 8, further comprising:

applying a smoothing process on a noise component of the second noise-added spectrum.

14. The decoding method according to claim 13, wherein an energy change is smoothened between frames of the second noise-added spectrum using an energy of the noise component of the second noise-added spectrum calculated based on a threshold value, and wherein an amplitude of the noise component of the second noise-added spectrum is adjusted using a scaling coefficient representing a ratio between a noise component energy of the noise component of the second noise-added spectrum and an energy of the noise component of the second noise-added spectrum to be obtained after smoothing.

15. A non-transitory storage medium having stored thereon a computer program for performing, when running on a computer, a method of claim 8.

16. A decoding device, comprising:

a separator that separates first encoded data, where a spectrum including a low-band spectrum of audio signals has been encoded, and second encoded data where a high-band spectrum of a higher band than the low-band spectrum has been encoded, based on the first encoded data;

a first decoder that decodes the first encoded data and generates a first decoded spectrum;

a first amplitude normalizer that divides the amplitude of the first decoded spectrum into a plurality of sub-bands, normalizes the spectrum of each sub-band by the largest value of the amplitude of the first decoded spectrum within each sub-band, and generates a normalized spectrum;

an adder that adds a noise spectrum to the normalized spectrum and generates a noise-added normalized spectrum;

a second decoder that decodes the second encoded data using the noise-added normalized spectrum, and generates a second noise-added spectrum;

an amplitude readjuster that applies a smoothing process on a noise component of the second noise-added spectrum, wherein the amplitude readjuster is configured to smoothen an energy change between frames of the second noise-added spectrum using an energy of the noise component of the second noise-added spectrum calculated based on a threshold value, and to adjust an amplitude of the noise component of the second noise-added spectrum using a scaling coefficient representing a ratio between a noise component energy of the noise component of the second noise-added spectrum and an energy of the noise component of the second noise-added spectrum to be obtained after smoothing; and a converter that performs frequency-time conversion regarding a spectrum generated by concatenating a spectrum based on the first decoded spectrum and a spectrum based on the second noise-added spectrum.

17. A decoding method, comprising:

separating first encoded data, where a spectrum including a low-band spectrum of audio signals has been encoded, and second encoded data where a high-band spectrum of a higher band than the low-band spectrum has been encoded, based on the first encoded data;

decoding the first encoded data and generating a first decoded spectrum;

dividing the amplitude of the first decoded spectrum into a plurality of sub-bands, normalizing the spectrum of each sub-band by the largest value of the amplitude of the first decoded spectrum within each sub-band, and generating a normalized spectrum;

adding a noise spectrum to the normalized spectrum and generating a noise-added normalized spectrum;

decoding the second encoded data using the noise-added normalized spectrum, and generating a second noise-added spectrum;

applying a smoothing process on a noise component of the second noise-added spectrum, wherein the applying comprises smoothing an energy change between frames of the second noise-added spectrum using an energy of the noise component of the second noise-added spectrum calculated based on a threshold value, and adjusting an amplitude of the noise component of the second noise-added spectrum using a scaling coefficient representing a ratio between a noise component energy of the noise component of the second noise-added spectrum and an energy of the noise component of the second noise-added spectrum to be obtained after smoothing; and performing a frequency-time conversion regarding a spectrum generated by concatenating a spectrum based on the first decoded spectrum and a spectrum based on the second noise-added spectrum.

18. A non-transitory storage medium having stored thereon a computer program for performing, when running on a computer, a method of claim 17.

* * * * *